United States Patent [19]

Kimura et al.

[11] Patent Number: 4,490,107

[45] Date of Patent: Dec. 25, 1984

[54] METHOD OF PROCESSING CHARGES IN A CONTINUOUS COMBUSTION FURNACE

[75] Inventors: Kensaku Kimura, Matsudo; Toshio Watanabe, Kita-Kyushu, both of Japan

[73] Assignees: Kurosaki Furnace Industries Company Limited, Tokyo; Kurosaki Refractries Company Limited, Kyushu, both of Japan

[21] Appl. No.: 535,701

[22] Filed: Sep. 26, 1983

Related U.S. Application Data

[62] Division of Ser. No. 332,240, Dec. 18, 1981, Pat. No. 4,444,557.

[51] Int. Cl.[3] ..... F27D 3/00; F26B 9/12

[52] U.S. Cl. ..... 432/11; 432/18; 432/21; 432/22

[58] Field of Search ..... 432/11, 18, 19, 21, 432/17, 22, 64, 136, 137, 143, 144, 145, 146, 149, 150

[56] References Cited

U.S. PATENT DOCUMENTS

| | | | |
|---|---|---|---|
| 1,874,516 | 8/1932 | Hartford | 432/137 |
| 3,038,711 | 6/1962 | Gummeson et al. | 432/137 |
| 3,168,298 | 2/1965 | Cook et al. | 432/135 |
| 4,310,300 | 1/1982 | Mackenzie | 432/18 |

FOREIGN PATENT DOCUMENTS

| | | | |
|---|---|---|---|
| 1181677 | 2/1970 | United Kingdom | 432/137 |

*Primary Examiner*—John J. Camby

*Attorney, Agent, or Firm*—Martin Smolowitz

[57] ABSTRACT

A continuous combustion furnace in which the charges to be heat processed is passed through the tunnel in the kiln having three temperature zones comprising a preheating zone, a firing zone subsequent to the preheating zone and a cooling zone subsequent to the firing zone, wherein turbulant flows of atmosphere are induced in each of the temperature zones so that the charges are preheated, fired and thereafter cooled uniformly.

15 Claims, 25 Drawing Figures

FIG. 20
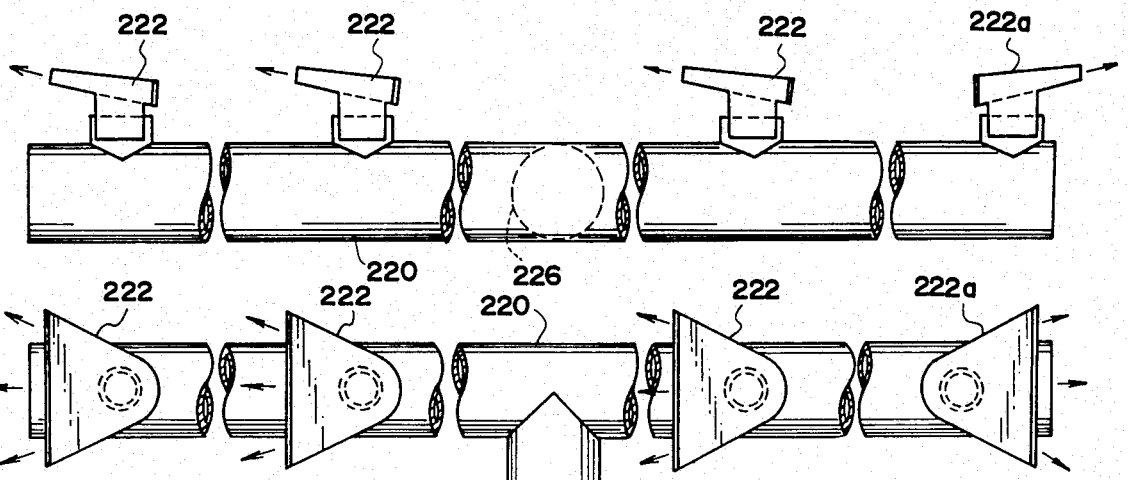
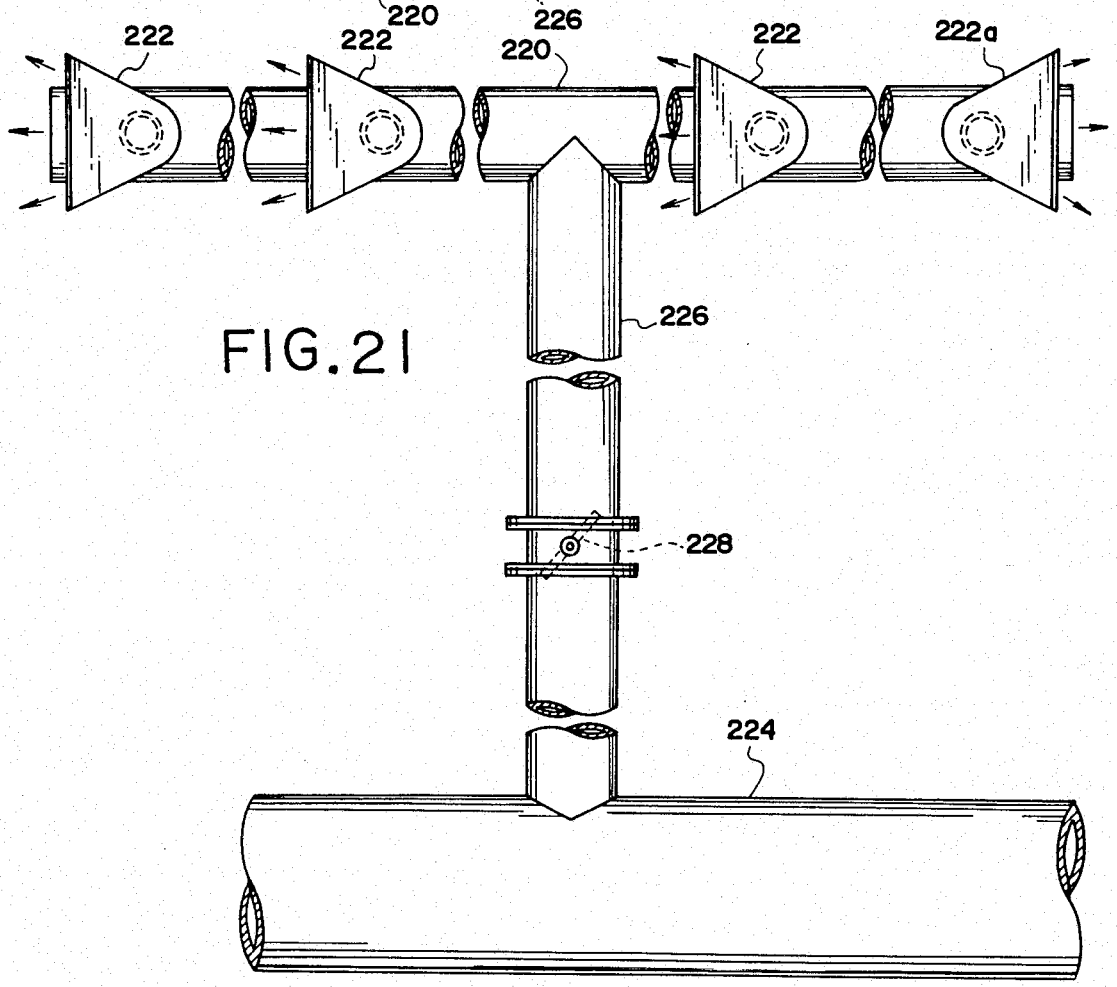
FIG. 21

METHOD OF PROCESSING CHARGES IN A CONTINUOUS COMBUSTION FURNACE

This is a division of application Ser. No. 332,240 filed on Dec. 18, 1981, now U.S. Pat. No. 4,444,557.

FIELD OF THE INVENTION

The present invention relates to an industrial continuous combustion furnace and to a method of heat processing charges in the furnace. The charges to be heat processed by the furnace according to the present invention may be bricks, tiles and other refractory materials such as ceramics or metals to be forged or rolled. The continuous combustion furnace to which the present invention appertains is, specifically, of the type which is generally known as a tunnel kiln.

BACKGROUND OF THE INVENTION

One of the important requirements in heat processing charges in a tunnel kiln is to control the distributions of the pressures and temperatures of the atmosphere in the kiln throughout the length of the kiln. The distribution of the pressure of the atmosphere in the kiln is closely related to the distribution of the flows of the atmosphere in the kiln and is predominant over the fuel economy of the kiln.

A tunnel kiln usually has three temperature zones which consist of a preheating zone, a firing zone and a cooling zone. The distribution of the pressure of the atmosphere in the kiln is usually such that the pressure droops from the cooling zone toward the preheating zone through the firing zone, or from the firing zone to the cooling and preheating zones, or from the cooling and firing zones toward the preheating zone. With any of these patterns of distribution, the pressure of the atmosphere in a tunnel kiln decreases toward the preheating zone so that the atmosphere in the kiln tends to propagate toward the preheating zone. In order to save the fuel consumption in the kiln and to process charges under optimum conditions, therefore, it is important to properly regulate the flows of the atmosphere toward the preheating zone of the kiln.

In the firing zone of a kiln, charges are burned or fired by transfer of heat thereto directly from the flames produced by the combustion of fuel and radiation of heat from the hot walls of the kiln. Less emphasis is thus placed on convection of heat to the charges than on radiation of heat to the charges in the kiln. This makes it to maintain the temperature of the atmosphere uniform vertically in the tunnel in the kiln so that the charges in the firing zone of the kiln tend to be fired excessively in one region and deficiently in another region of the tunnel in the kiln.

To avoid such localized heating of charges, efforts have been paid to improve the combustion efficiency of the fuel burners to be used and to form soft flames around the charges to be fired. The tunnel kiln of a conventional continuous combustion furnace has therefore been provided with relatively large combustion chambers for the fuel burners. In view, however, of the fact that such combustion chambers must be formed by highly heat-resistant, extremely costly refractories and that such refractories must be shaped intricately to provide proper configurations of the combustion chambers, disproportionately large amounts of cost and labor have been required to construct the kiln with such combustion chambers. Because, furthermore, each of the combustion chambers in the kiln is subjected to an extremely large amount of thermal load (which is usually of the order of about 200,000 to 1,000,000 k·cal/m$^3$·hr), operators of the furnace are compelled to work in serious environments due to the heat dissipated from the outer walls of the kiln.

The hot products of combustion produced in the firing zone of a tunnel kiln move upwardly from the burner tips toward the ceiling of the kiln and are permitted to flow along the ceiling toward the preheating zone without having sufficiently exchanged heat with the charges being conveyed in the firing zone. The hot gases thus directed into the preheating zone are caused to flow downwardly away from the ceiling of the kiln by means of a drop arch or a drop air curtain formed in the preheating zone or by suitable forced recirculation fans provided in the preheating zone and are thus discharged from the tunnel in the kiln into the flue formed in the side walls of the kiln. Problems are however encountered in a furnace having such a preheating zone in that the charges conveyed into the preheating zone, particularly, those being moved through a lower portion of the tunnel in the preheating zone can not be sufficiently preheated and are thus subjected to the attack of heat at suddenly increased temperatures in the firing zone subsequent to the preheating zone and in that the heat produced in the firing zone is wasted uselessly from the preheating zone and gives rise to an increase in the fuel consumption rate in the firing zone.

The present invention contemplates elimination of these and other drawbacks of prior-art inductrial continuous combustion furnaces.

SUMMARY OF THE INVENTION

In accordance with one outstanding aspect of the present invention, there is provided a continuous combustion fornace comprising a tunnel kiln elongated between an open entrance end and an open exit end and having a pair of side walls spaced apart substantially in parallel laterally of the kiln and longitudinally extending between the entrance and exit ends of the kiln and an upper wall bridging the side walls throughout the length of the kiln for forming a tunnel longitudinally extending between the entrance and exit ends of the kiln, the tunnel kiln having a preheating zone longitudinally extending in the tunnel forwardly from the entrance end of the kiln, a firing zone longitudinally extending forwardly from the preheating zone, and a cooling zone longitudinally extending forwardly from the firing zone and terminating at the exit end of the kiln, the preheating zone including a waste-gas discharge area longitudinally extending forwardly away from the entrance end of the kiln toward the firing zone and a forced circulation area longitudinally extending forwardly from the waste-gas discharge area to the firing zone.

Each of the side walls of the kiln may be formed with a plurality of burner chambers, a plurality of flame ports respectively communicating with the burner chambers and open to the tunnel in the kiln in the firing zone in lateral directions of the kiln, the flame ports in each of the side walls being formed in alternately upper and lower portions of the side wall and in staggered relationship to the flame ports in the other side wall longitudinally of the kiln, a plurality of hot-gas injection ports open to the tunnel in the kiln in the forced circulation area of the preheating zone in lateral directions of the kiln, a plurality of suction ports open to the tunnel in the kiln in the forced circulation area of the preheating zone in lateral directions of the kiln and respectively communicating with the aforesaid hot-gas injection ports, the hot-gas injection ports in each of the side walls being formed in alternately upper and lower portions of the side walls and in staggered relationship to the hot-gas injection ports in the other side wall longitudinally of the kiln, the suction ports communicating with the hot-gas injection ports formed in the upper and lower portions of the side walls being formed in lower and upper portions, respectively, of the side walls, and a plurality of waste-gas discharge ports formed in a lower portion of each of the side walls and open to the tunnel in the kiln in the waste-gas discharge area of the preheating zone in lateral directions of the kiln.

Whereas, the cooling zone of the furnace according to the present invention may include a high-temperature indirect cooling area longitudinally extending forwardly from the firing zone, a direct cooling area longitudinally extending forwardly from the high-temperature indirect cooling area, and a low-temperature indirect cooling area longitudinally extending forwardly from the direct cooling area and terminating in the vicinity of the exit end of the kiln, each of the side walls of the kiln being formed with a plurality of vertical cooling-gas injection chambers arranged in staggered relationship to the cooling-gas injection chambers in the other of the side walls longitudinally of the kiln, a number of cooling-gas outlet slots formed in a plurality of groups in a lower portion of each side wall and open to the tunnel in the kiln in the direct cooling area of the cooling zone in lateral directions of the kiln, and a number of cooling-gas circulation ports formed in a plurality of groups in an upper portion of each of the side walls and open to the tunnel in the kiln in the direct cooling area in lateral directions of the kiln, each of the cooling-gas injection chamber providing communication from each group of the cooling-gas outlet ports and each group of the cooling-gas circulation ports.

The continuous combustion furnace according to the present invention may further comprise a pressure regulator system which comprises first forced-circulation fresh-air feed means operative to blow fresh air into a lower portion of the tunnel in the kiln inwardly in lateral directions of the kiln in the firing zone and at least a longitudinal portion of the cooling zone, second forced-circulation fresh-air feed means operative to blow fresh air upwardly into a bottom portion of the tunnel in the kiln in the firing zone and at least the longitudinal portion of the cooling zone, first forced-circulation air discharge means operative to discharge air from the tunnel in the kiln outwardly in lateral directions of the kiln in at least a longitudinal portion of the preheating zone, and second forced-circulation air discharge means operative to discharge air downwardly from a bottom portion of at least the longitudinal portion of the firing zone.

In accordance with another outstanding aspect of the present invention, there is provided a method of heat prodessing charges loaded on charge loading blocks of a train of charge carrier cars travelling through a tunnel kiln elongated between an open entrance end and an open exit end and having a pair of side walls spaced apart substantially in parallel laterally of the kiln and longitudinally extending between the entrance and exit ends of the kiln and an upper wall bridging the side walls throughout the length of the kiln for forming a tunnel longitudinally extending between the entrance and exit ends of the kiln, comprising (1) passing the charges through an entrance air shutoff area in which an air curtain is formed in the tunnel in the kiln adjacent the entrance end of the kiln, (2) passing the charges through a waste-gas discharge area subsequent to the entrance air shutoff area and filled with hot waste gases being discharged from the tunnel in the kiln through the waste-gas discharge area, (3) passing the charges through a forced-circulation preheating area subsequent to the waste-gas discharge area and filled with hot gases injected into the forced circulation preheating area and forming turbulent flows therein, (4) passing the charges through a firing zone subsequent to the forced-circulation preheating area and filled with hot gases produced by high-velocity flames injected through the side walls of the kiln into the tunnel in the kiln, (5) passing the charges through a high-temperature indirect cooling area subsequent to the firing zone and having the side and upper walls of the kiln cooled with fresh air being circulated internally of the walls, (6) passing the charges through a direct cooling area subsequent to the high-temperature indirect cooling area and filled with a mixture of fresh air and gases being recirculated into and out of the direct cooling area, (7) passing the charges through a low-temperature cooling area subsequent to the direct cooling area and being cooled by transfer of heat to finned cooling tubes through which fresh air is being circulated, and (8) passing the charges through an exit air shutoff area in which an air curtain is formed in the tunnel in the kiln adjacent the exit end of the kiln. The high-velocity flames may be injected into alternately upper and lower portions of the tunnel in the kiln in the firing zone from each of the side walls of the kiln in lateral directions of the kiln for producing in the tunnel turbulent flows of hot gases which tend to swirl in the tunnel in lateral and vertical directions of the kiln. Furthermore, the high-velocity flames may be injected into the tunnel in the kiln from each of the side walls of the kiln in directions staggered with respect to the directions in which the high-velocity flames are injected into the tunnel in the kiln from the other side wall of the kiln. On the other hand, hot gases are injected into alternately upper and lower portions of the tunnel in the kiln in the forced-circulation preheating area from each of the side walls of the kiln for producing in the tunnel turbulent flows of hot gases which tend to swirl in the tunnel in lateral and vertical directions of the kiln. In this instance, hot gases may be further injected downwardly into the tunnel in the kiln in the forced-circulation preheating area through the upper wall of the kiln. Furthermore, the mixture of air and gases may be injected into a lower portion of the tunnel in the kiln in lateral directions of the kiln in the direct cooling area of the cooling zone for establishing forced convection of heat in the tunnel in the kiln in the direct cooling area of the cooling zone. By preference, a method according to the present invention may further comprise blowing fresh air into a bottom portion of the tunnel in the kiln inwardly in lateral directions of the kiln in the firing zone and at least a longitudinal portion of the cooling zone, blowing fresh air upwardly into a bottom portion of the tunnel in the kiln in the firing zone and at least the above mentioned longitudinal portion of the cooling zone, discharging air from a bottom portion of the tunnel in the kiln outwardly in lateral directions of the kiln in at least a longitudinal portion of the preheating zone, and discharging air downwardly from a bottom portion of the tunnel in the kiln in at least the above mentioned longitudinal portion of the preheating zone.

BRIEF DESCRIPTION OF THE DRAWINGS

The features of the continuous combustion furnace and the method according to the present invention will be more clearly understood from the following description taken in conjunction with the accompanying drawings, in which:

FIG. 20 is a fragmentary side elevation view showing portions of the duct arrangement forming part of the pressure regulator system in the firing and cooling zones of the furnace illustrated in FIG. 18;

FIG. 21 is a fragmentary plan view showing portions of the duct arrangements illustrated in FIG. 20;

DESCRIPTION OF THE PREFERRED EMBODIMENTS

Figure 1:
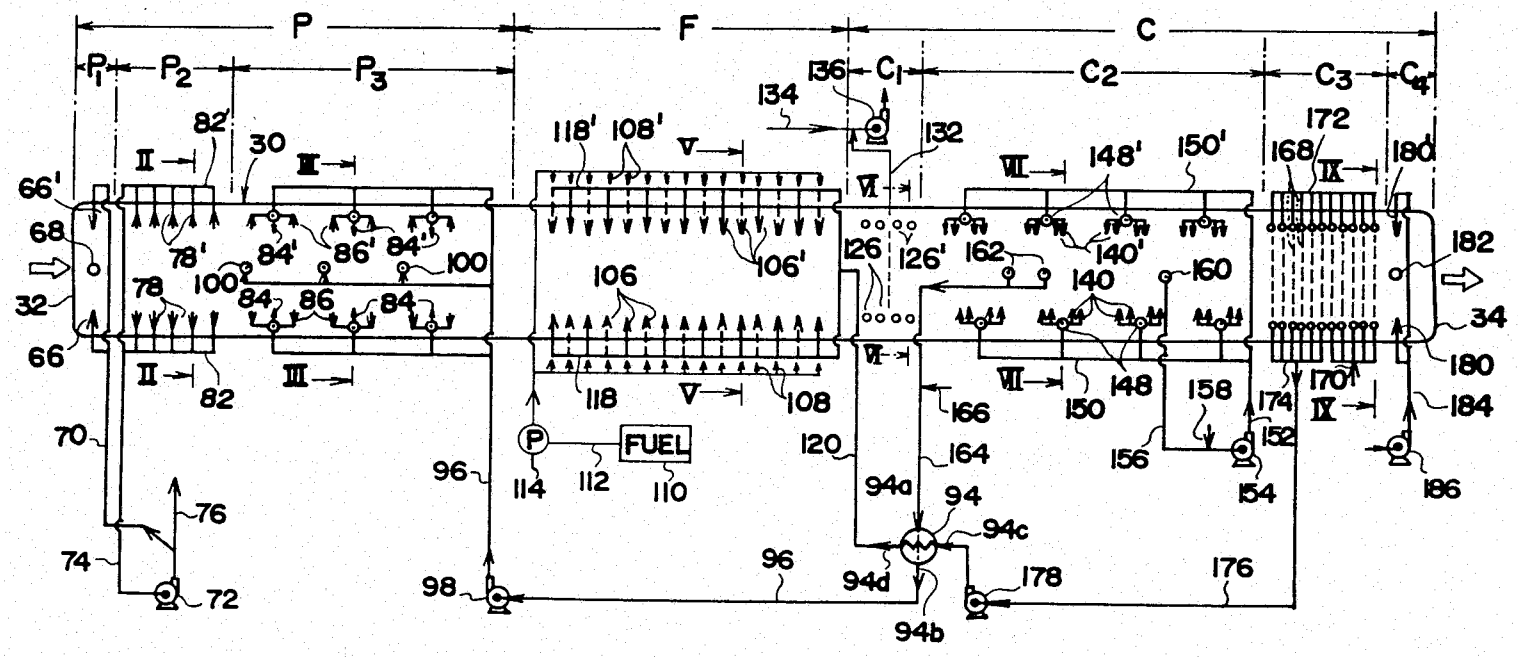
FIG. 1 is a schematic plan view of the preheating, firing and cooling zones of a continuous combustion furnace embodying the present invention.
Figure 2:
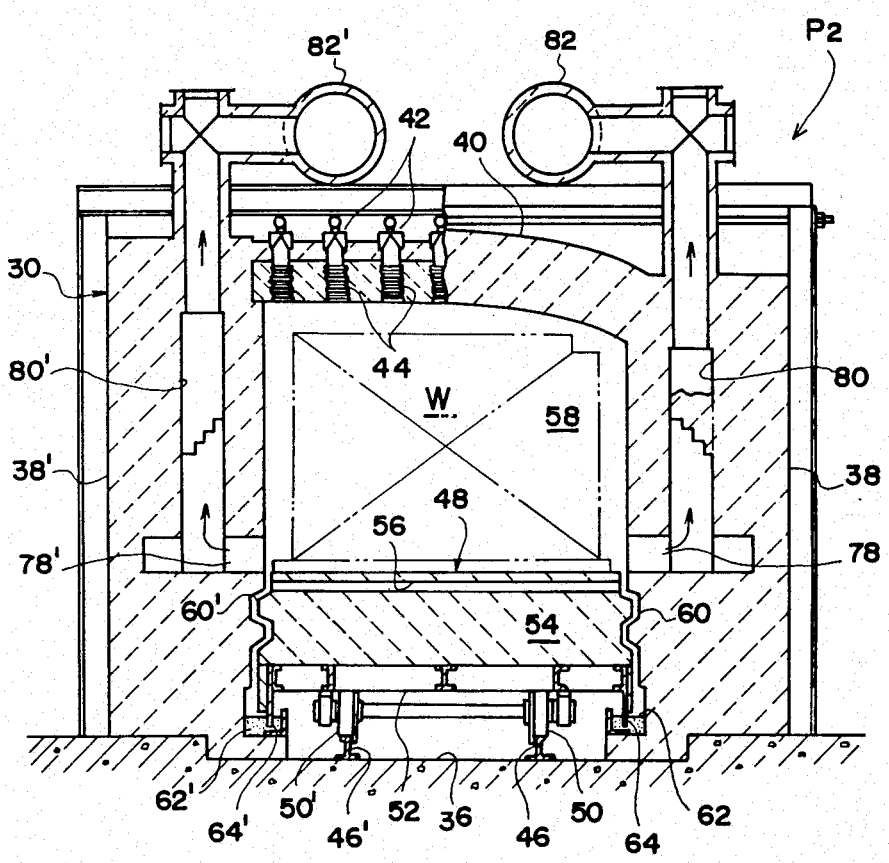
FIG. 2 is a cross sectional view taken on a vertical plane indicated by lines II—II in FIG. 1.

Description will be hereinafter made in regard to the first preferred embodiment of the continuous combustion furnace according to the present invention. Referring first to FIG. 1 of the drawings, the continuous combustion furnace embodying the present invention is constituted by a tunnel kiln 30 horizontally elongated between an open entrance end 32 and an open exit end 34. As will be seen from FIGS. 2 to 9 of the drawings, the tunnel kiln 30 is built on sleepers (not shown) embedded in a horizontal floor 36 of refractory cement and has a pair of side walls 38 and 38' upstanding from the upper surface of the floor 36 and spaced apart in parallel from each other laterally of the kiln 30. The tunnel kiln 30 further has an upper wall 40 bridging the side walls 38 and 38' and thereby forming a tunnel longitudinally extending from the entrance end 32 to the exit end 34 of the kiln 30. The upper wall 40 of the kiln 30 has a partially horizontal and partially arcuate cross section and is suspended by suspension rods 42 by means of hanger bricks 44 each anchored at its upper end to one of the suspension rods 42 and having a threaded lower portion embedded in the upper wall 40 of the kiln 30. The suspension rods 42 extend longitudinally of the kiln 30 and are provided in a plurality of groups arranged at suitable intervals therebetween longitudinally of the kiln 30. Each of the side walls 38 and 38' and upper wall 40 of the kiln 30 is assumed, by way of example, as being composed of layers of firebricks but may be constructed of other refractory materials such as a heat resistant plastic if desired.

A pair of spaced parallel rails 46 and 46' are laid on the floor surface 36 and longitudinally extend throughout the length of the tunnel in the kiln 30 and partially outwardly from the entrance and exit ends 32 and 34 of the kiln 30. Though not shown in the drawings, the rails 46 and 46' are laid on sleepers embedded in the floor 36 and are horizontally spaced apart at a predetermined distance from each other transversely of the kiln 30. A train of charge carrier cars 48 is movable on these rails 46 and 46' into and out of and through the tunnel in the kiln 30. Each of the charge carrier cars 48 has two sets of flanged wheels 50 and 50' rollable on the rails 46 and 46', respectively, a chassis structure 52 composed of a number of longitudinal and cross beams of steel and carried on the axles of the wheels 50 and 50', and a charge loading block 54 composed of layers of, for example, firebricks and supported on the chassis structure 52. The charge loading block 54 of each carrier car 48 has a number of lateral heat distribution passageways 56 formed in an upper wall portion of the block 54 and each open at the opposite lateral ends of the block 54. The purpose of the heat distribution passageways 56 thus formed in the charge loading bock 54 will be understood as the description proceeds. The charge loading block 54 of each of the carrier cars 44 has a flat, horizontal upper surface on which a batch of materials or a stack of workpieces to be burned, fired, sintered, annealed or otherwise thermally processed is to be loaded. In the description to follow, the batch of materials or the stack of workpieces to be thus processed will be referred to simply as "charge". In FIGS. 2 to 9 of the drawings, the charge thus loaded on the charge loading block 54 of each of the charge carrier cars 48 is schematically indicated by phantom lines and is designated by W.

When the train of charge carrier cars 48 is moving in the tunnel kiln 30, the charge loading blocks 54 of the cars 48 form a furnace chamber 58 vertically between the upper surfaces of the blocks 54 and the lower faces of the upper wall 40 of the kiln 30 and laterally between the side walls 38 and 38' of the kiln 30. Furthermore, the side faces of the charge loading block 54 of each of the charge carrier cars 48 are laterally spaced apart slightly inwardly from the inner faces of lower portions of the side walls 38 and 38', respectively, of the kiln 30 and form a side clearance 60 between one side face of the block 54 and one side wall 38 of the kiln 30 and a side clearance 60' between the other side face of the block 54 and the other side wall 38' of the kiln 30. These side clearances 60 and 60' are open at their upper ends to the above mentioned furnace chamber 58 and are sealed from the space below the charge loading block 54 of each charge carrier car 48 by suitable side sealding means. In the embodiment herein shown, such sealing means comprises a pair of sand ditches 62 and 62' formed along lowermost end portions of the side walls 38 and 38', respectively, of the kiln 30 and extending longitudinally of the tunnel in the kiln 30, and a pair of side sealing plates 64 and 64' depending from lateral end portions of the charge loading block 54 of each of the charge carrier cars 48. The side sealing plates 64 and 64' of the individual charge carrier cars 48 have lower end portions submerged in the sand stored in the sand ditches 62 and 62', respectively, and thereby isolate the above mentioned side clearances 60 and 60' from the space below the charge loading blocks 54 of the train of charge carrier cars 48. Though not shown in the drawings, the charge carrier cars 48 are provided with means sealing the gaps between the respective charge carrier blocks 54 of the cars 48. The sealing means thus provided at the respective foremost and rearmost ends of the charge loading blocks 54 of every two charge carrier cars 48 also serves to seal the furnace chamber 58 from the space below the charge loading blocks 54 of the individual charge carrier cars 48.

Turning back to FIG. 1 of the drawings, the tunnel in the kiln 30 arranged as described above has three temperature zones which consist of a preheating zone P longitudinally extending in the tunnel in the kiln 30 inwardly or forwardly from the entrance end 32 of the kiln 30, a firing zone F merging forwardly out of the preheating zone P and longitudinally extending in an intermediate portion of the tunnel in the kiln 30, and a cooling zone C fowardly extending from the firing zone F and terminating at the exit end 34 of the kiln 30. The preheating zone P in turn has three successive areas which consist of an entrance air shotoff area $P_1$ adjacent the entrance end 32 of the kiln 30, a waste-gas discharge area $P_2$ merging forwardly out of the entrance air shutoff area $P_1$, and a forced circulation area $P_3$ merging forwardly out of the waste-gas discharge area $P_2$ into the firing zone F. On the other hand, the cooling zone C has four successive areas which consist of a high-temperature indirect cooling area $C_1$ merging forwardly out of the firing zone F, a direct cooling area $C_2$ merging forwardly out of the high-temperature indirect cooling area $C_1$, a low-temperature indirect cooling area $C_3$ merging forwardly out of the direct cooling area $C_2$, and an exit air shutoff area $C_4$ intervening between the low-temperature indirect cooling area $C_3$ and the exit end 34 of the kiln 30. The ratios between the respective lengths of the preheating, firing and cooling zones P, F, and C are preferably about 40 to 44:20 to 25:35 to 36.

In the entrance air shutoff area $P_1$ of the preheating zone P is established an air curtain formed by a layer of jets of hot air ejected toward the charge W on the charge loading block 54 of a car 48 in the entrance air shutoff area $P_1$ from nozzles 66 and 66' provided in the side walls 38 and 38', respectively, and nozzles 68 provided in the upper wall 40 of the kiln 30. As schematically shown in FIG. 1, these nozzles 66, 66' and 68 thus provided in the walls 38, 38' and 40 of the kiln 30 lead through a hot-gas feed passageeway 70 from an outlet end of suitable forced-flow or induced-flow producing means such as the delivery port of a power-driven forced-circulation fan 72 having a suction port communicating with the waste-gas discharge area $P_2$ of the preheating zone P through a waste-gas discharge flue 74. The hot waste gas thus discharged from the waste-gas discharge area $P_2$ to the forced-circulation fan 72 through the flue 74 is partially directed to the nozzles 66, 66' and 68 in the kiln 30 through the passageway 70 and partially ejected into the open air through a chimney 76 which also leads from the delivery port of the fan 72.

In the waste-gas discharge area $P_2$ of the preheating zone P, the side walls 38 and 38' of the kiln 30 have a series of waste-gas discharge ports 78 formed in one side wall 38 and arranged at suitable intervals in a longitudinal direction of the kiln 30 and a series of waste-gas discharge ports 78' formed in the other side wall 38' and also arranged at suitable intervals in a longitudinal direction of the kiln 30 as schematically shown in FIG. 1. As will be seen more clearly from FIG. 2, the waste-gas discharge ports 78 and 78' are open to the furnace chamber 58 in lateral directions of the kiln 30 and in the vicinity of the lower end of the furnace chamber 58. The ports 78 in the side wall 38 respectively communicate with vertical flues 80 also formed in the side wall 38 and, likewise, the ports 78' in the side wall 38' respectively communicate with vertical flues 80' formed in the side wall 38'. The vertical flues 80 in the side wall 38 jointly lead to a common longitudinal flue 82 and, likewise, the vertical flues 80' in the side wall 38' jointly lead to a common longitudinal flue 82'. The longitudinal flues 82 and 82' extend above the upper wall 40 of the kiln 30 and jointly communicate with the above mentioned waste-gas discharge flue 74 terminating in the suction port of the force-circulation fan 72 shown in FIG. 1. Preferably, the waste-gas discharge ports 78 in the side wall 38 of the kiln 30 are respectively aligned with the waste-gas discharge ports 78' in the side wall 38' of the kiln 30 in lateral directions of the kiln 30 as will be seen from the schematic illustration of FIG. 1. Each of the intervals between the ports 78 in the side wall 38 and each of the intervals between the ports 78' in the side wall 38' are, preferably, approximately equal to one half of the fore-and-aft measurement of each of the charge carrier cars 48.

Figure 3:
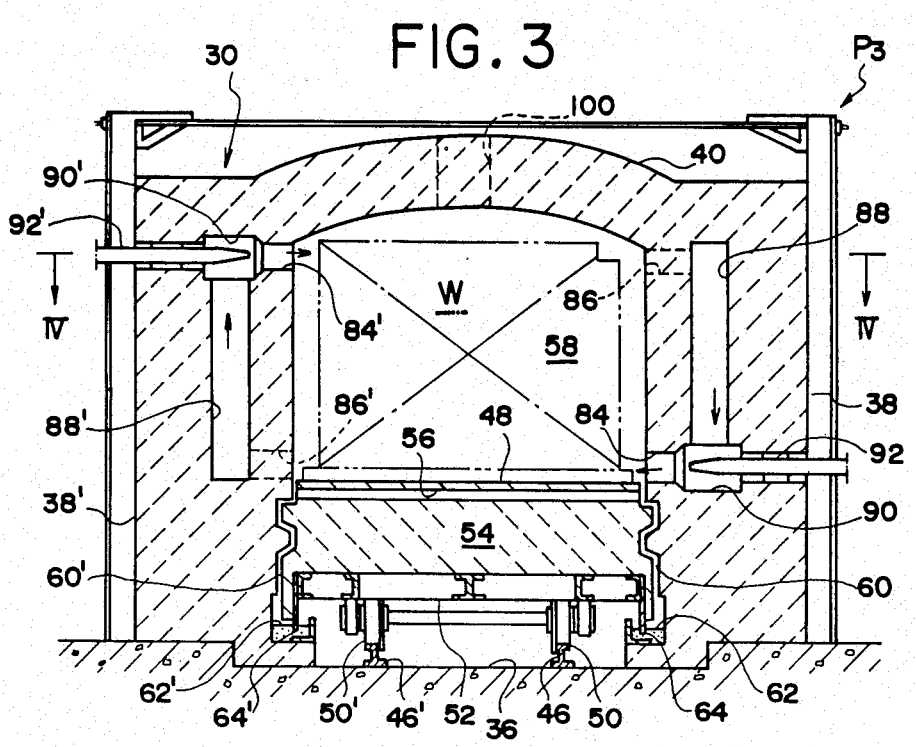
FIG. 3 is a cross sectional view taken on a vertical plane indicated by lines III—III in FIG. 1.
Figure 4:
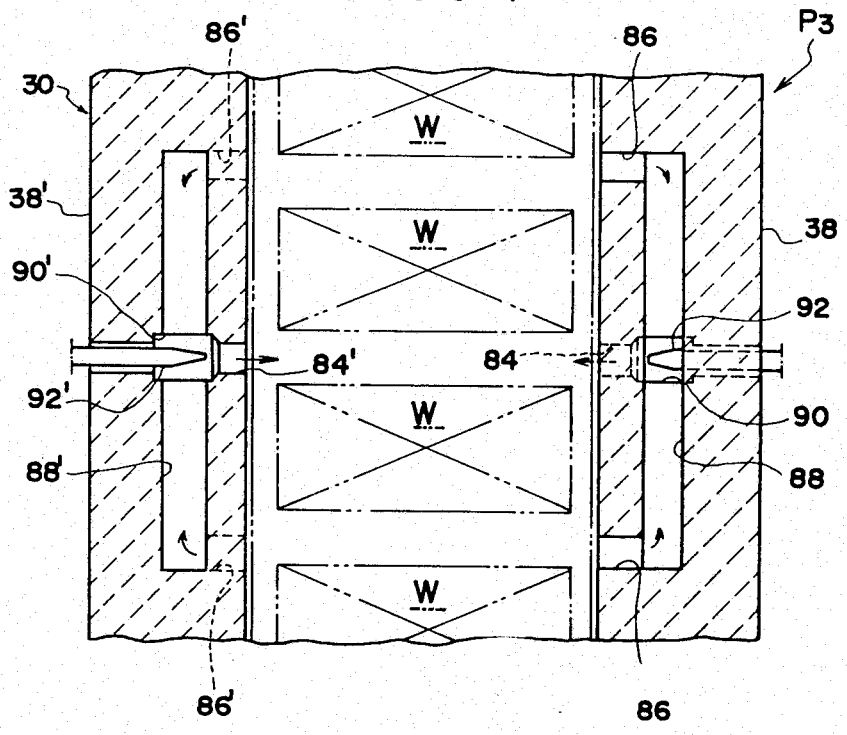
FIG. 4 is a fragmentary horizontal sectional view taken on a horizontal plane indicated by lines IV—IV in FIG. 3.

On the other hand, the forced circulation area $P_3$ of the preheating zone P has a plurality of hot-gas injection ports 84 formed in the side wall 38 and a plurality of hot-gas injection ports 84' formed in the side wall 38' of the kiln 30 as will be better seen from FIGS. 3 and 4 of the drawings. The hot ports 84 in the side wall 38 are open to the furnace chamber 58 in lateral directions of the kiln 30 and are arranged in the vicinity of alternately the upper and lower ends of the furnace chamber 58. The hot-gas injection ports 84' in the side wall 38' are also open to the furnace chamber 58 in lateral directions of the kiln 30 and are arranged in the vicinity of alternately the lower and upper ends of the furnace chamber 58 and in staggered relationship to the hot-gas injection ports 84 in the side wall 38. The ports 84' in the side wall 38' are, furthermore, preferably located to have their respective center axes on vertical planes containing the respective center axes of the ports 84 in the side wall 38 as will be seen from FIG. 4. In the forced circulation area $P_3$ of the preheating zone P, the side walls 38 and 38' of the kiln 30 are further formed with a plurality of suction ports 86 and a plurality of suction ports 86', respectively, the suction ports 86 and 86' being also open to the furnace chamber 58 in lateral directions of the kiln 30. The suction ports 86 in the side wall 38 consist of plural pairs of suction ports, each pair of which is associated with each of the hot-gas injection ports 84 in the side wall 38 and is located in the vicinity of the upper or lower end of the furnace chamber 58 in conjunction with the associated hot-gas injection port 84 located in the vicinity of the lower or upper end, respectively, of the furnace chamber 58. Similarly, the suction ports 86' in the side wall 38' of the kiln 30 consist of plural pairs of suction ports, each pair of which is associated with each of the hot-gas injection ports 84' in the side wall 38' and is located in the vicinity of the lower or upper end of the furnace chamber 58 in conjunction with the associated hot-gas injection port 84' located in the vicinity of the upper and lower end, respectively, of the furnace chamber 58. Furthermore, each pair of suction ports 86 in the side wall 38 are arranged to have their respective center axes on vertical planes containing the respective center axes of the pair of suction ports 86' in the side wall 38'. Thus, the hot-gas injection ports 84 and suction ports 86 in the side wall 38 are located diagonally with respect to the hot-gas injection ports 84' and suction ports 86', respectively, in the side wall 38' in cross sections of the kiln 30.

The side walls 38 and 38' of the kiln 30 in the forced circulation area $P_3$ of the preheating zone P are further formed with a plurality of gas recirculation chambers 88 and a plurality of gas recirculation chambers 88', respectively. Each of the gas recirculation chambers 88 in the side wall 38 provides communication from each pair of suction ports 86 to the associated hot-gas injection port 84 in the side wall 38 and, likewise, each of the gas recirculation chambers 88' in the side wall 38' provides communication from each pair of suction ports 86' to the associated hot-gas injection port 84' in the side wall 38'. A gas-mixing chamber 90 is formed between each of the hot-gas injection ports 84 and the gas recirculation chamber 88 communicating therewith in the side wall 38 and, likewise, a gas mixing chamber 90' is formed between each of the hot-gas injection ports 84' and the gas recirculation chamber 88' communicating with the particular hot-gas injection port 84' in the side wall 38'. Hot-gas injection nozzles 92 project axially into the gas mixing chambers 90, respectively, in the side wall 38 and, similarly, hot-gas injection nozzles 92' project axially into the gas mixing chambers 90', respectively, in the side wall 38'. The hot-gas injection nozzles 92 and 92' are directed toward the furnace chamber 58 in lateral directions of the kiln 30 across the associated hot-gas injection ports 84 and 84', respectively, and communicate with suitable heat recovery means such as a heat recuperator or a heat regenerator. In the embodiment herein shown, the heat recovery means is constituted by a heat recuperator 94 having, as schematically shown in FIG. 1, a hot-gas inlet port 94*a*, a hot-gas outlet port 94*b*, an air inlet port 94*c* and an air outlet port 94*d* as will be described in more detail. The hot-gas outlet port 94*b* of the recuperator 94 communicates through a hot-gas distribution passageway 96 and across suitable forced-flow or induced-flow producing means such as a power-driven forced-circulation fan 98 with the above mentioned hot-gas injection nozzles 92 and 92'.

In the forced circulation area $P_3$ of the preheating zone P is further provided hot-gas downdraft means comprising a plurality of downwdraft ports 100 formed in the upper wall 40 of the kiln 30 as indicated by dotted lines in FIG. 3. The downdraft ports 100 are downwardly open to the furnace chamber 58 and jointly communicate with the above mentioned hot-gas distribution passageway 96 communicating with the hot-gas outlet port 94*b* of the above described heat recuperator 94 through the forced-circulation fan 98. Each of the downdraft ports 100 may be open to the furnace chamber 58 in a strictly vertical direction or in a generally vertical direction slightly inclined toward the entrance end 32 of the kiln 30. The downdraft ports 100 are located preferably in staggered relationship to the hot-gas injection ports 84 and 84' in each of the side walls 38 and 38' when viewed in plan, as will be seen from the schematic illustration of FIG. 1.

Figure 5:
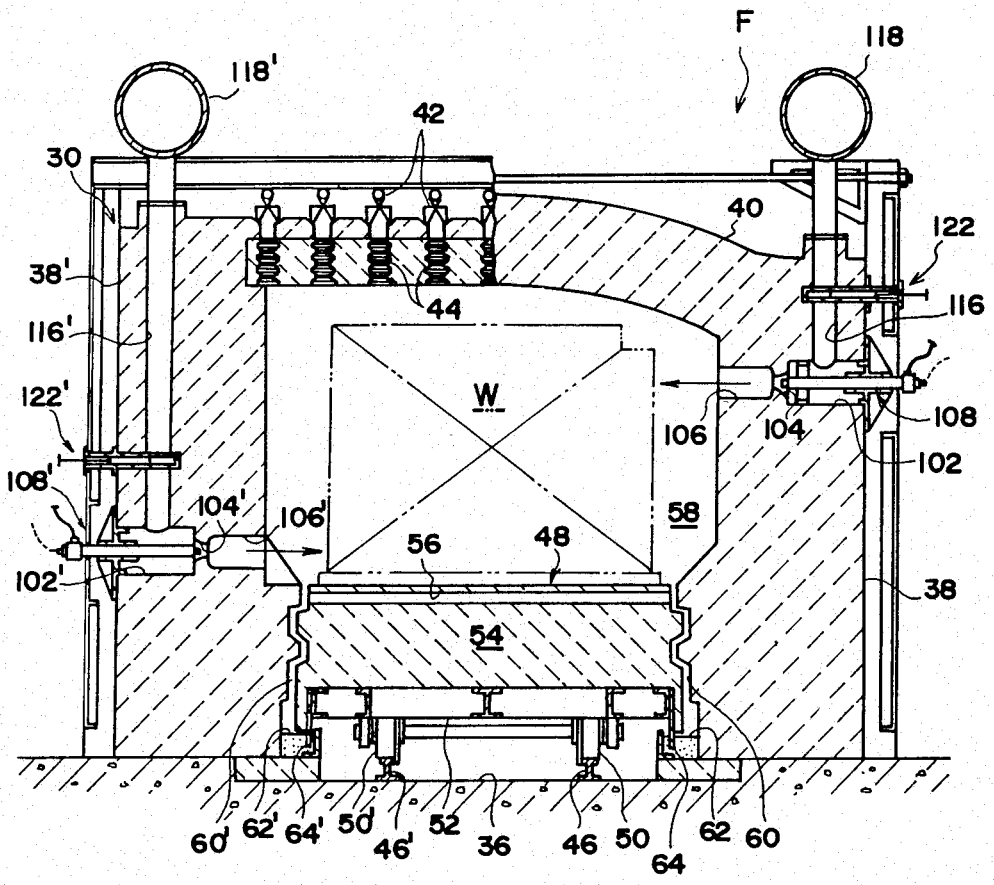
FIG. 5 is a cross sectional view taken on a vertical plane indicated by lines V—V in FIG. 1.

On the other hand, the firing zone F has in the side walls 38 and 38' of the kiln 30 a plurality of burner chambers 102 formed in the side wall 38 and a plurality of burner chambers 102' formed in the side wall 38' as shown in FIG. 5 of the drawings. Each of the burner chambers 102 in the side wall 38 is elongated transversely of the side wall 38 and has a reduced innermost portion constituting fuel-injection nozzle 104. The fuel injection nozzle 104 is open to a flame port 106 which is also formed in the side wall 38 and which is open to the furnace chamber 58 in a lateral direction of the kiln 30. Similarly, each of the burner chambers 102' in the side wall 38' of the kiln 30 is elongated transversely of the side wall 38' and has a reduced innermost portion constituting a fuel injection nozzle 104' open to a flame port 106' which is formed in the side wall 38' and which is open to the furnace chamber 58 in lateral direction of the kiln 30. The flame ports 106 in the side wall 38 are arranged in the vicinity of alternately the upper and lower ends of the furnace chamber 58 and, similarly, the flame ports 106' in the side wall 38' are arranged in the vicinity of alternately the lower and upper ends of the furnace chamber 58 and in staggered relationship to the flame ports 106 in the side wall 38. The flame ports in each side wall of the kiln 30 are arranged at the intervals of preferably one half of the fore-and-aft measurement of each of the charge carrier cars 48. A high-velocity burner 108 axially projects through each of the burner chambers 102 in the side wall 38 into the fuel injection nozzle 104 forming part of the burner chamber 102 and, likewise, a high-velocity fuel burner 108' axially projects through each of the burner chambers 102' in the side wall 38' into the fuel injection nozzle 104' forming part of the burner chamber 104', as shown in FIG. 5. The high-velocity fuel burners 108 and 108' thus provided in the firing zone F of the kiln 10 jointly communicate with a suitable source 110 of fuel oil or gas through a fuel feed passageway 112 having a suitable fuel feed pump 114 incorporated therein as schematically illustrated in FIG. 1.

In the firing zone F, the side walls 38 and 38' of the kiln 30 further have a series of vertical hot-air supply passageways 116 formed in the side wall 38 and a series of vertical hot-air supply passageways 116' as shown in FIG. 5. The hot-air supply passageways 116 in the side wall 38 extend upwardly from the burner chambers 102, respectively, in the side wall 38 and terminate at their respective upper ends in a common hot-air distribution duct 118 and, likewise, the hot-air supply passageways 116' in the side wall 38' extend vertically from the burner chambers 102', respectively, in the side wall 38' and terminate at their respective upper ends in a common hot-air distribution duct 118'. The two hot-air distribution ducts 118 and 118' longitudinally extend above and along the upper wall 40 of the kiln 30 as will be seen from FIG. 5 and jointly communicate through a hot-air feed passageway 120 with the hot-air outlet port **94*d* of the previously mentioned heat recuperator 94 as shown in FIG. 1. Each of the hot-air supply passageways 116 and 116' in the side walls 38 and 38', respectively, is provided with suitable draft regulator means for manually or automatically regulating the draft of air through each of the hot-air supply passageways 116 and 116'. In the arrangement shown in FIG. 5, such draft regulator means is constituted by a damper assembly 122 provided in association with each of the hot-air supply passageways 116 in the side wall 38 and a damper assembly 122' provided in association with each of the hot-air supply passageways 106' in the side wall 38'**.

Figure 6:
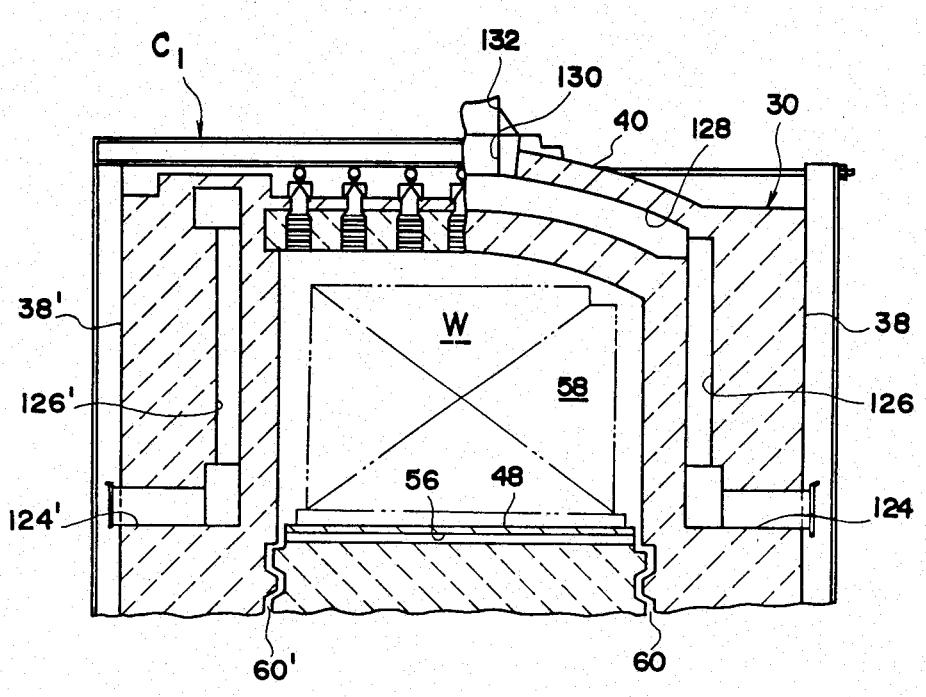
FIG. 6 is a fragmentary cross sectional view taken on a vertical plane indicated by lines VI—VI in FIG. 1.

In the high-temperature cooling area $C_1$ of the cooling zone C, the side walls 38 and 38' of the kiln 30 have a suitable number of fresh-air inlet ports 124 formed in the side wall 38 and open to the atmosphere outside the side wall 38 and a suitable number of fresh-air inlet ports 124' formed in the side wall 38' and open to the atmosphere outside the side wall 38' as shown in FIG. 6 of the drawings. The fresh-air inlet ports 124 and 124' thus formed in the side walls 38 and 38' of the kiln 30 are directed toward but not open to a lower end portion of the furnace chamber 58 and are open to vertical fresh-air circulation passageways 126 and 126', respectively, which are also formed in the side walls 38 and 38' of the kiln 30. The fresh-air circulation passageways 126 extend upwardly from the fresh-air inlet ports 124 and terminate at their upper ends in a common air discharge passageway 128 formed in the upper wall 40 of the kiln 30. The fresh-air circulation passageways 126' likewise extend upwardly from the fresh-air inlet ports 124' and terminate at their upper ends in a common air discharge passageway 128' formed in the upper wall 40 of the kiln 30. The air discharge passageways 128 is open to an air outlet port 130 also formed in the upper wall 40 of the kiln 30 and communicates through the air outlet port 130 with an air outlet duct 132 extending from the top of the upper wall 40 of the kiln 30 as partially shown in FIG. 6. As illustrated schematically in FIG. 1, the air outlet duct 132 terminates in a suction passageway 134 leading to a suction port of suitable induced-flow producing which is shown constituted, by way of example, by a power-driven forced-circulation fan 136 having a delivery port open to the atmosphere. In lieu of the arrangement including the air outlet passageway 132 and the forced-circulation fan 136 shown in FIG. 1, suitable forced-flow inducing means (not shown) may be provided in communication with the fresh-air inlet ports 124 and 124' in the side walls 38 and 38', respectively, of the kiln 30 so as to produce forced flows of air from the individual air inlet ports 124 and 124' into the fresh-air circulation passageways 126 and 126', respectively, by the forced-flow producing means.

Figure 7:
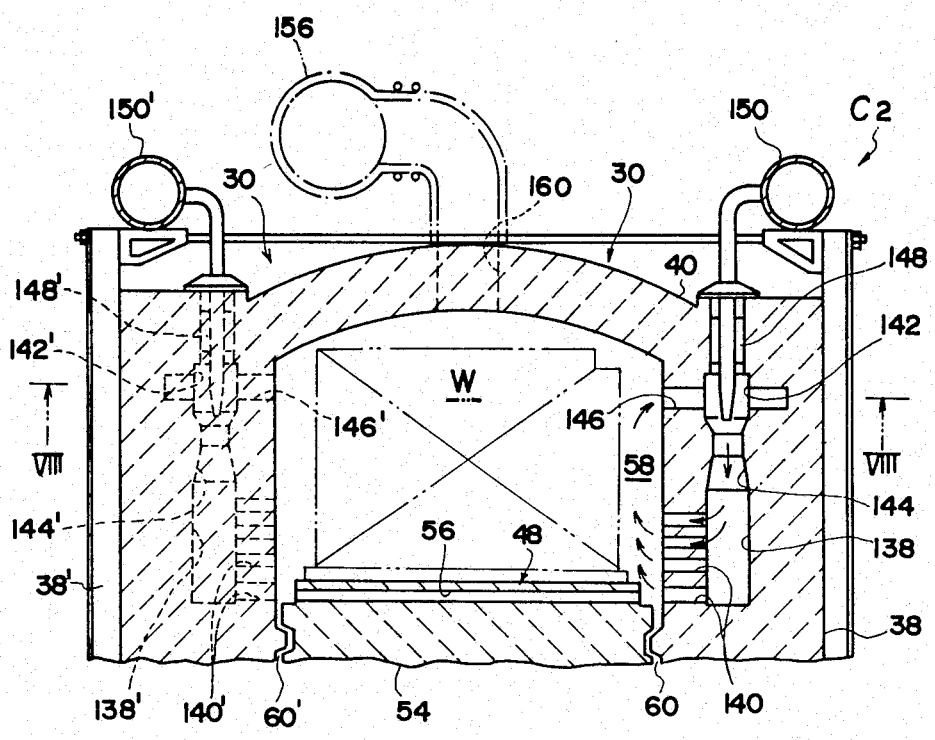
FIG. 7 is a fragmentary cross sectional view taken on a vertical plane indicated by lines VII—VII in FIG. 1.
Figure 8:
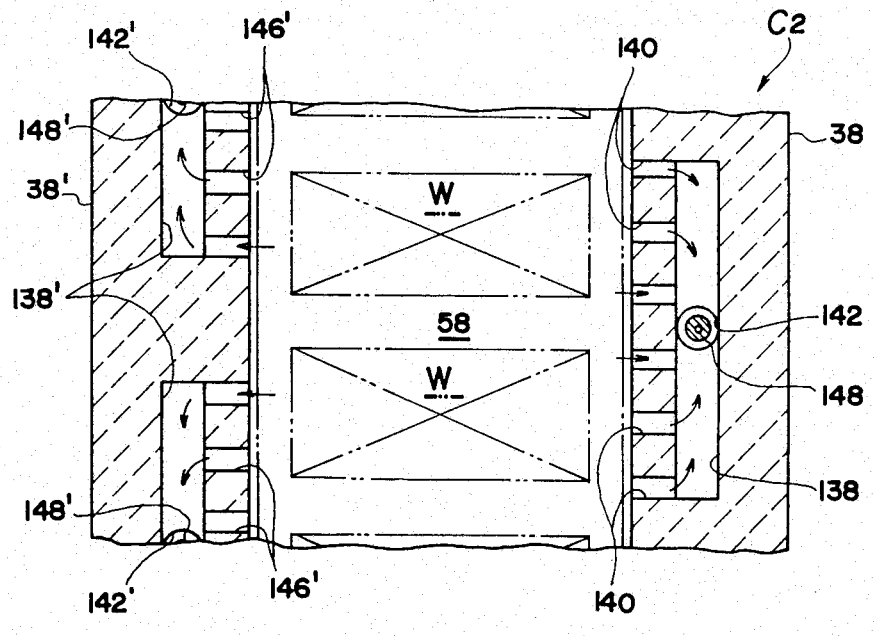
FIG. 8 is a fragmentary horizontal sectional view taken on a horizontal plane indicated by lines VIII—VIII in FIG. 7.

In the forced-cooling area $C_2$ of the cooling zone C, the side walls 38 and 38' of the kiln 30 have a series of vertical cooling-gas injection chambers 138 formed in the side wall 38 and a series of vertical cooling-gas injection chambers 138' formed in the side wall 38' as shown in FIGS. 7 and 8 of the drawings. As will be seen from FIG. 1 as well as FIG. 8, the cooling-gas injection chambers 138 in the side wall 38 are arranged in staggered relationship to the cooling-gas injection chambers 138' in the side wall 38' longitudinally of the kiln 30. Each of the cooling-gas injection chambers 138 and 138' is elongated in a longitudinal direction of the kiln 30 with a suitable length. Each of the cooling-gas injection chambers 138 in the side wall 38 communicates with the furnace chamber 58 through a number of cooling-gas outlet slots 140 formed in the side wall 38 and open to a lower portion of the furnace chamber 58 in lateral directions of the kiln 30. Each of the cooling-gas injection chambers 138' in the side wall 38' likewise communicates with the furnace chamber 58 through a number of cooling-gas outlet slots 140' formed in the side wall 38' and open to a lower portion of the furnace chamber 58 in lateral directions of the kiln 30. The side walls 38 and 38' of the kiln 30 in the direct cooling area $C_2$ of the cooling zone C further have a series of cooling-gas mixing chambers 142 formed in the side wall 38 and a series of cooling-gas mixing chambers 142' formed in the side wall 38'. Each of the cooling-gas mixing chambers 142 in the side wall 38 is downwardly open to each of the cooling-gas injection chambers 138 through a diffuser passageway 144 having a lower leading end portion divergent toward the cooling-gas injection chamber 138. Similarly, each of the cooling-gas mixing chambers 142' in the side wall 38' is downwardly open to each of the cooling-gas injection chambers 138' through a diffuser passageway 144' having a lower leading end portion divergent toward the cooling-gas injection chamber 138'. Each of the cooling-gas mixing chambers 142 in the side wall 38 is further open to a plurality of cooling-gas circulation ports 146 also formed in the side wall 38 and, likewise, each of the cooling-gas mixing chambers 142' in the side wall 38' is further open to a plurality of cooling-gas circulation ports 146' formed in the side wall 38'. The cooling-gas circulation ports 146 thus formed in the side wall 38 are open to an upper end portion of the furnace chamber 58 in lateral directions of the kiln 30 and, likewise, the cooling gas circulation ports 146' formed in the side wall 38' are open to an upper end portion of the furnace chamber 58 in lateral directions of the kiln 30. A cooling-gas injection nozzle 148 axially projects downwardly into each of the cooling-gas mixing chambers 142 in the side wall 38 and, similarly, a cooling-gas injection nozzle 148' axially projects downwardly into each of the cooling-gas mixing chambers 142' in the side wall 38'. The individual cooling-gas injection nozzles 148 thus projecting into the side wall 38 of the kiln 30 jointly lead from a common cooling-gas distribution duct 150 extending longitudinally along and above the side wall 38 and, likewise, the individual cooling-gas injection nozzles 148' projecting into the side wall 38' of the kiln 30 jointly lead from a common cooling-gas distribution duct 150' extending longitudinally along and above the side wall 38'. As schematically illustrated in FIG. 1, the two cooling-gas distribution ducts 150 and 150' are branched from a single cooling-gas feed passageway 152 leading from, for example, an air delivery port of suitable forced-flow or induced-flow producing means such as a power-driven forced-recirculation fan 154 having a suction port communicating with a cooling-gas supply passageway 156 which is on one hand open to the atmosphere as indicated at 158 and which is on the other hand in communication with the furnace chamber 58 through a cooling-gas recirculation port 160 formed in the upper wall 40 of the kiln 30. The cooling-gas recirculation port 160 in the upper wall 40 of the kiln 30 is preferably located in the vicinity of the low-temperature end of the direct cooling area $C_2$ of the cooling zone C, viz., closer to the low-temperature cooling area $C_3$ than to the high-temperature cooling area $C_1$ of the cooling zone C as will be seen from FIG. 1.

As illustrated schematically in FIG. 1, the upper wall 40 of the kiln 30 in the direct cooling area $C_2$ of the cooling zone C is further formed with a suitable number of hot-gas recirculation ports 162 which are downwardly open to the furnace chamber 58 (FIGS. 7 and 8) and which jointly communicate through a hot-gas recirculation passageway 164 with the hot-gas inlet port 94*a* of the previously mentioned heat recuperator 94. As will be seen from the schematic illustration of FIG. 1, the hot-gas recirculation ports 162 are preferably located closer to the high-temperature indirect cooling area $C_1$ than to the low-temperature indirect cooling area $C_3$ of the cooling zone C. By preferance, furthermore, the hot-gas recirculation passageway 162 may be in part open to the atmosphere as indicated at 166 in FIG. 1.

In the low-temperature indirect cooling area $C_3$ of the cooling zone C are provided a plurality of finned cooling tubes 168 which are arranged in lateral directions of the kiln 30 as shown in FIG. 1. As will be better seen from FIG. 9 of the drawings, each of the finned cooling tubes 168 has a pair of vertical side portions extending along the inner faces of the side walls 38 and 38', respectively, of the kiln 30 and a generally horizontal upper portion extending between the side portions along the inner face of the upper wall 40 of the kiln 30. Some of the finned cooling tubes 168 commonly lead from a fresh-air inlet duct 170 open to the atmosphere and communicate through a duct 172 with the other finned cooling tubes 168 which commonly terminate in an air outlet duct 174. The air outlet duct 174 in turn is in communication through a duct 176 with the air inlet port 94*c* of the heat recuperator 94 by way of suitable forced-flow or induced-flow producing means such as a power-driven forced-circulation fan 178 as shown in FIG. 1.

In the exit air shutoff area $C_4$ of the cooling zone C is established an air curtain formed by a layer of jets of fresh air ejected toward the charge W on the charge loading block 54 of a charge carrier car 48 in the exit air shutoff area $C_4$ from nozzles 180 and 180' provided in the side walls 38 and 38', respectively, and nozzles 182 provided in the upper wall 40 of the kiln 30 as schematically shown in FIG. 1. The nozzles 180, 180' and 182 thus provided in the walls 38, 38' and 40, respectively, of the kiln 30 lead through a fresh-air feed passageways 183 from an outlet end of suitable forced-flow or induced-flow producing means such as the delivery port of a power-driven forced-circulation fan 184 having its suction port open to the atmosphere.

Throughout operation of the furnace thus constructed and arranged, the above mentioned forced-circulation fan 184 is constantly driven to produce a forced flow of fresh air through the fresh-air feed passageway 184 so as to eject jets of fresh air from the nozzles 180, 180' and 182 into the kiln 30 in the exit air shutoff area $C_4$ of the cooling zone C. An air curtain is thus maintained between the low-temperature indirect cooling area $C_3$ and the exit end 34 of the kiln 30 and shuts off entry of air into the tunnel in the kiln 30 or a flow of gases out of the tunnel in the kiln 30 through the exit end 34 of the kiln 30. Similarly, the forced-circulation fan 72 for the entrance air shutoff area $P_1$ of the preheating zone P is also constinuously driven to produce a forced flow of hot air through the hot-air feed passageway 70 so as to eject jets of hot air from the nozzles 66, 66' and 68 into the kiln 30 in the entrance air shutoff area $P_1$. An air curtain is thus also maintained between the waste-gas discharge area $P_2$ of the preheating zone P and the entrance end 32 of the kiln 30 and shuts off entry of air into the tunnel in the kiln 30 or a flow of hot gases out of the tunnel in the kiln 30 through the entrance end 32 of the kiln 30. The tunnel in the kiln 30 is in these manners isolated from the atmospheric air at the entrance and exit ends 32 and 34 of the kiln 30 by the air curtains maintained in the entrance and exit air shutoff areas $P_1$ and $C_4$ of the preheating and cooling zones P and C, respectively, of the kiln 30.

Furthermore, the forced-circulation fan 178 provided in the duct 176 leading from the finned tubes 168 in the flow-temperature cooling area $C_3$ of the cooling zone C is continuously driven to establish an induced flow of air through the duct 176 and accordingly in the finned cooling tubes 168. Fresh atmospheric air is therefore constantly introduced into the finned cooling tubes 168 through the air inlet duct 170 and is heated as the air is circulated through the individual cooling tubes 168. The air thus heated is constantly supplied from the ducts 174 and 176 to the inlet port 94*c* of the heat recuperator 94 and is further heated in the recuperator 94 by the hot air being passed from the hot-gas inlet port 94*a* to the hot-gas outlet port 94*b* of the recuperator 94. The hot air delivered from the air outlet port 94*d* of the heat recuperator 94 is directed through the hot-air feed passageway 120 to the hot-air distribution ducts 118 and 118' (FIG. 5) and by way of the ducts 118 and 118' to the hot-air supply passageways 116 and 116' in the side walls 38 and 38' of the kiln 30 in the firing zone F. On the other hand, fuel oil or gas is constantly supplied at a controlled rate from the fuel source 110 to the individual fuel burners 108 and 108' in the firing zone F by means of the fuel feed pump 114 and is injected at a high velocity into each of the flame ports 106 and 106' in the side walls 38 and 38' of the kiln 30 in the firing zone F.

As fuel is thus injected at a high velocity through each of the fuel injection nozzles 104 and 104' in the side walls 38 and 38', respectively, of the kiln 30, a flow of air is induced from each of the burner chambers 102 and 102' toward each of the flame ports 106 and 106' so that the hot air directed into each of the hot-air supply passageways 116 and 116' as above described is forced through each of the fuel injection nozzles 104 and 104' and is admixed to the fuel spurting from each of the fuel injection nozzles 104 and 104' to each of the flame ports 106 and 106'. A mixture of fuel and hot air thus produced in each of the fuel injection nozzles 104 and 104' and each of the flame ports 106 and 106' is fired in each of the flame ports 106 and 106' so that a jet stream of hot products of combustion is injected into the furnace chamber 58 from each of the flame ports 106 and 106' in the side walls 38 and 38', respectively of the kiln 30. The jet streams of the products of combustion injected into the furnace chamber 58 from the flame ports 106 and 106' open to a lower end portion of the furnace chamber 58 and the jet streams of products of the combustion injected into the furnace chamber 58 from the flame ports 106 and 106' open to an upper end portion of the furnace chamber 58 form high-velocity flows of hot gases which tend to swirl along the inner faces of the side walls 38 and 38' and upper wall 40 of the kiln 30. In the presence of the charges W on the charge loading blocks 54 of the charge carrier cars 48 in the firing zone F of the kiln 30, turbulent flows of hot gases are thus produced around each of the charges W carried into the firing zone F and heat the charges W uniformly while the charges W are being moved through the firing zone F. The hot combustion gases produced in the furnace chamber 58 in the firing zone F of the kiln 30 are partially directed into the heat distribution passageways 56 in the charge loading blocks 54 of the cars 48 in the firing zone F and heats the charges W on the charge loading blocks 54 from bottom portions of the charges W by direct conduction of heat from the charge loading blocks 54 to the charges W thereon.

The fuel burners 108 and 108' herein used are preferably of the type to produce sufficiently short high-velocity flames from the nozzles thereof so as to prevent the charges W from being locally heated or burned directly by the flames and to enable the flames to be diluted with the atmosphere in the furnace chamber 58 immediately when the flames are injected into the furnace chamber 58. Since the flames produced by the fuel burners 108 and 108' are thus diluted instantaneously, the burners 108 and 108' need not be provided with pre-combustion chambers in the side walls 38 and 38' of the kiln 30. For this reason and because, furthermore, of the fact that flame ports 106 and 106' in the side walls 38 and 38', respectively, are located laterally deep in the kiln 30, the loss of heat from the furnace chamber 58 by the conduction of heat through the side walls 38 and 38' and the radiation of heat from the outer surfaces of the side walls 38 and 38' of the kiln 30 can be reduced to a minimum. To exploit these advantages in a furnace according to the present invention, it is advisable to use burners with fuel injection velocities higher than approximately 20 meters/sec and burning capacities higher than approximately $2\times10^7$ k·cal/m$^3$·hr if oil is to be used as fuel or burners with fuel injection velocities higher than approximately 80 meters/sec and burning capacities higher than approximately $5\times10^7$ k·cal/m$^3$·hr if combustible gas is used as fuel.

The hot atmosphere produced in the firing zone F as described above propagates to the high-temperature indirect cooling area $C_1$ and direct cooling area $C_2$ of the cooling zone C as the train of charge carrier cars 48 travels forwardly through the tunnel in the kiln 30. In the high-temperature indirect cooling area $C_1$ of the cooling zone C, fresh air is being circulated through the fresh-air circulation passageways 126 and 126' (FIG. 6) in the side walls 38 and 38', respectively, of the kiln 30 with the forced-circulation fan 136 being continuously driven to produce an induced flow of air through the suction passageway 134 and accordingly an induced flow of air in the air outlet duct 132 leading from the air outlet port 130 in the upper wall 40 of the kiln 30. The hot gases propagating through the high-temperature indirect cooling area $C_1$ toward the direct cooling area $C_2$ of the cooling zone F are thus cooled by exchanging of heat between the hot gases contacting the inner faces of the side walls 38 and 38' of the kiln 30 and the fresh air being circulated through the fresh-air circulation passageways 126 and 126' in the side walls 38 and 38', respectively, of the kiln 30. The hot gases primarily cooled in the high-temperature indirect cooling area $C_1$ as above described enter the direct cooling area $C_2$ of the cooling zone C and are mixted with the gases being blown into the furnace chamber 58 from the cooling-gas outlet slots 140 and 140' (FIGS. 7 and 8) in the side walls 38 and 38', respectively, of the kiln 30. The gases blown from the cooling-gas outlet slots 140 and 140' into the furnace chamber 58 in the direct cooling area $C_2$ of the cooling zone C contain a mixture of fresh air sucked as at 158 into the cooling-gas supply passageway 156 (FIG. 1) and the hot gases sucked into the passageway 156 through the cooling-air circulation port 160 in the upper wall 40 of the kiln 30. The mixture of the hot gases and fresh air thus sucked into the cooling-gas supply passageway 156 by means of the forced-circulation fan 154 is directed through the cooling-gas feed passageway 152 and further by way of the cooling-gas distribution ducts 150 and 150' to the cooling-gas injection nozzles 148 and 148' projecting into the cooling-gas mixing chambers 142 and 142' in the side walls 38 and 38', respectively, of the kiln 30 in the direct cooling area $C_2$ of the cooling zone C. The mixture of the hot gases and fresh air thus directed to each of the cooling-gas injection nozzles 148 and 148' is injected into each of the diffuser passageways 144 and 144' and through each diffuser passageway into each of the cooling-gas injection chambers 138 and 138' and is further injected into the furnace chamber 58 through the cooling-gas outlet slots 140 leading from each of the cooling-gas supply chambers 138 in the side wall 38 and through the cooling-gas outlet slots 140' leading from each of the cooling-gas supply chambers 138' in the side wall 38' of the kiln 30. The cooling gases thus injected into the furnace chamber 58 through the cooling-gas outlet slots 140 and 140' are heated by the hot gases propagating from the firing zone F and are partially recirculated to the cooling-gas supply passageway 156 through the cooling-gas recirculation port 160 in the upper wall 40 of the kiln 30 and partially drawn into the cooling-gas supply chambers 138 and 138' through the cooling-gas circulation ports 146 and 146' in the side walls 38 and 38', respectively, of the kiln 30 by the suction induced in each of the cooling-gas mixing chambers 142 and 142' by the jet stream of gas spurting from each of the injection nozzles 148 and 148'. The cooling gases thus forced into each of the cooling-gas mixing chambers 142 and 142' through each of the cooling-gas circulation ports 146 and 146' are mixed with the mixture of hot gases and fresh air injected from each of the nozzles 148 and 148' into each of the cooling-gas mixing chambers 142 and 142', respectively. Thus, the atmosphere in the furnace chamber 58 in the direct cooling area $C_2$ of the cooling zone C is constantly diluted with the fresh air contained in the mixture supplied from the cooling-gas injection nozzles 148 and 148' and extracts heat from the hot gases propageted from the firing zone F. The cooling gases in the furnace chamber 58 in the direct cooling area $C_2$ of the cooling zone C are further partially drawn through the hot-gas recirculation ports 162 in the upper wall 40 of the kiln 30 into the hot-gas recirculation passageway 164 (FIG. 1) by the suction established by the forced-circulation fan 98 in the hot-gas distribution passageway 96 leading from the hot-gas outlet port **94*b* of the heat recuperator 94. The gases thus drawn into the hot-gas recirculation passageway 164 are passed from the hot-gas inlet port 94*a* to the hot-gas outlet port 94*b* of the heat recuperator 94 and give heat to the air being passed from the air inlet port 94*c* to the air outlet port 94*d* of the heat recuperator 94. The heat recuperator 94** to achieve such a function may be constituted by a heat exchanger of, for example, the known parallel-flow, counterflow or cross-flow type or any variation thereof.

The draft of the hot gases passed through the hot-gas outlet port **94*b* of the heat recuperator 94 into the hot-gas distribution passageway 96 by the suction established by the forced-circulation fan 98 is divided into three flows which consist of flows of hot gases to be distributed to the individual hot-gas injection nozzles 92 and 92' (FIGS. 3 and 4) projecting into the gas mixing chambers 90 and 90' in the side walls 38 and 38' of the kiln 30 and a flow of hot gases to be distributed to the downdraft ports 100 in the upper wall 40 of the kiln 30 in the forced circulation area $P_3$ of the preheating zone P. The hot gases distributed to the hot-gas injection nozzles 92 and 92' are injected into the furnace chamber 58 through each of the hot-gas injection ports 84 and 84' in the side wall 38 and 38', respectively, of the kiln 30 in lateral directions of the kiln 30. The streams of hot gases injected into the furnace chamber 58 from the hot-gas injection ports 84 and 84' open to a lower end portion of the furnace chamber 58 and the stream of hot gases injected into the furnace chamber 58 from the hot-gas injection ports 84 and 84' open to a lower end portion of the furnace chamber 58 form flows of hot gases which tend to swirl along the inner faces of the side walls 38 and 38' and upper wall 40 of the kiln 30. On the other hand, the gases distributed to the downdraft ports 100 in the upper wall 40 of the kiln 30 are downwardly injected into the furnace chamber 58. In the presence of the charges W on the charge loading blocks 54 of the charge carrier cars 48 in the forced circulation area $P_3$ of the preheating zone F and by virtue of the downward draft of the hot gases spurting from the downdraft ports 100 in the upper wall 40 of the kiln 30, the above mentioned flows of hot gases tending to swirl in the furnace chamber 58 are stirred up violently and are rendered into turbulent flows, uniformly heating the charges W on the charge carrier cars 48 traveling through the forced circulation area $P_3$. The turbulent flows thus produced in the furnace chamber 58 in the forced circulation area $P_3$ of the preheating zone P are partially admitted into the gas recirculation chambers 88 and 88' through the suction ports 84 and 84' in the side walls 38 and 38', respectively, of the kiln 30 due to the suction established in each of the gas mixing chambers 90 and 90' by the jet stream of hot air spurting from each of the hot-gas injection nozzles 92 and 92'. The hot gases thus forced into each of the gas recirculation chambers 88 and 88' through each of the suction ports 86 and 86' are mixed with the hot gases injected from each of the hot-gas injection nozzles 92 and 92' into each of the gas mixing chambers 90 and 90'. Thus, the hot gases which have exchanged heat with the charges W in the forced circulation rear $P_3$ of the preheating zone P are reheated by the hot gases supplied from the hot-gas injection nozzles 92 and 92'**.

The hot atmosphere which has thus heated the charges W in the forced circulation area $P_3$ propagates into the waste-gas discharge area $P_2$ of the preheating zone P. The hot waste gases serve to heat the charges W on the charge loading blocks 54 of the charge carrier cars 48 entering the forced circulation area $P_3$ of the preheating zone P and are forced to enter the vertical flues 80 and 80' (FIG. 2) through the waste-gas discharge ports 78 and 78' in the side walls 38 and 38', respectively, of the kiln 30, with the forced-circulation fan 72 continuously driven to establish an induced flow of gas in the waste-gas discharge passageway 74 (FIG. 1). The hot waste gases thus admitted into the vertical flues 90 and 80' in the side walls 38 and 38', respectively, of the kiln 30 are passed through the longitudinal flues 82 and 82' and further by way of the waste-gas discharge passageway 74 to the power driven fan 72 and are partially allowed to escape into the atmosphere through the chimney 76 and partially fed to the nozzles 66 and 66' in the side walls 38 and 38', respectively, and the nozzles 68 in the upper wall 40 of the kiln 30 in the entrance air shutoff area $P_1$ of the preheating zone P. In the entrance air shutoff area $P_1$ is thus established an air curtain formed by a layer of jet streams of hot gases ejected toward the charge W on the charge loading block 54 of a charge carrier car 48 in the entrance air shutoff area $P_1$ from the nozzles 66, 66' and 68.

Figure 9:
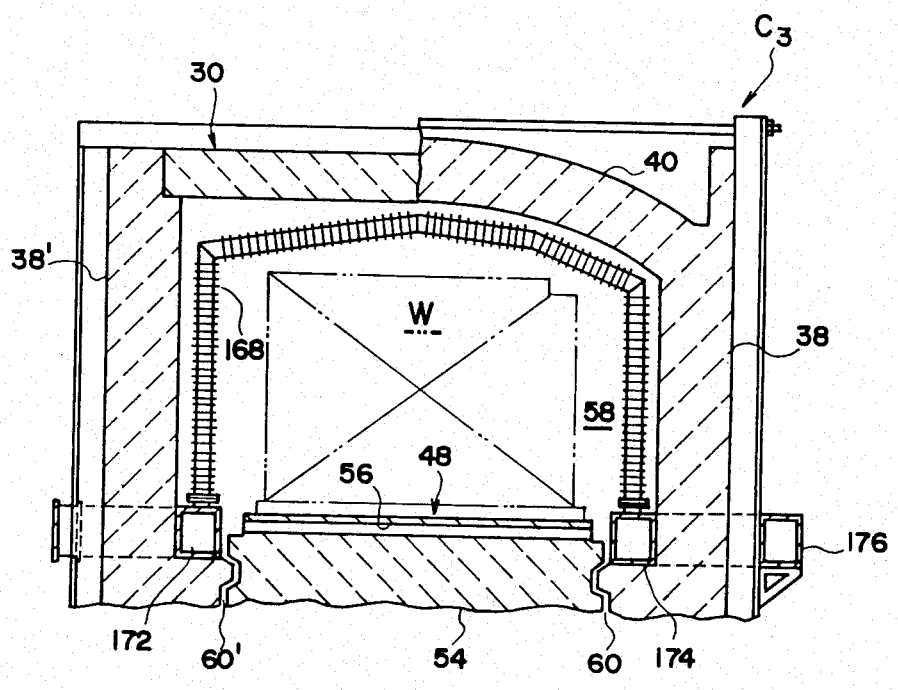
FIG. 9 is a fragmentary cross sectional view taken on a vertical plane indicated by lines IX—IX in FIG. 1.

The train of charge carrier cars 48 having the charges W carried on the charge loading blocks 54 thereof is driven to move through the tunnel in the kiln 30 either continuously or intermittently from the entrance end 32 to the exit end 34 of the kiln 30 by suitable drive means. The drive means may be constituted by a fluid-operated pusher (not shown) which per se is well known in the art. As a charge carrier car 48 is travelling through the waste-gas discharge area $P_2$ past the entrance air shutoff area $P_1$ of the preheating zone P, the charge on the charge loading block 54 of the car 48 is heated moderately by the hot waste gases propagated into the waste-gas discharge area $P_2$ from the forced circulation area $P_3$ of the preheating zone P. When the charge carrier car 48 enters the forced circulation area $P_3$ of the preheating zone P, the charge W thus heated preliminarily in the waste-gas discharge area $P_2$ is further heated by the turbulent flows of hot gases injected into the furnace chamber 58 through the hot-gas injection ports 90 and 90' from the hot-gas injection nozzles 92 and 92', respectively, and through the downdraft ports 100 (FIGS. 3 and 4). The charge W is thereafter fired, burned, baked, annealed, sintered or otherwise thermally processed in the firing zone F by the turbulent flows of the products of combustion produced by the firing of the oil or gas fuel injected into the furnace chamber 58 from the fuel burners 108 and 108' and ignited with the agency of the preliminarily heated air blown into the furnace chamber 58 through the hot-air supply passageways 116 and 116' (FIG. 5). The charge W thus processed in the firing zone F is cooled in the high-temperature indirect cooling area $C_1$ in which the hot gases surrounding the charge W on the charge loading block 54 of the charge carrier car 48 are caused to exchange heat with the fresh air being circulated through the fresh-air circulation passageways 126 and 126' (FIG. 6). The charge W is then positively cooled in the direct cooling area $C_2$ of the cooling zone C by the turbulent flows of cooling gases being circulated into the furnace chamber 58 partially through the cooling-gas circulation ports 146 and 146' and cooling-gas injection chambers 138 and 138' (FIGS. 7 and 8) and partially through the cooling-gas feed passageway 152 (FIG. 1). The charge W is thereafter conveyed from the direct cooling area $C_2$ into the low-temperature cooling area $C_3$ of the cooling zone C and is further cooled by conduction of heat from the atmosphere surrounding the charge W to the finned cooling tubes 168 in which fresh air is being continuously circulated (FIG. 9). Thereupon, the charge W is withdrawn from the tunnel in the kiln 30 past the exit air shutoff area $C_4$ of the cooling zone C.

From the foregoing description, the continuous combustion furnace embodying the present invention is characterized inter alia in that the flows of atmosphere in the tunnel kiln 30 are created primarily in the firing zone F. The hot products of combustion thus produced in the firing zone F and propagated into the cooling zone C are used not only for preheating the air to be mixed with the fuel to be combusted in the firing zone F but also for preheating the charges W in the preheating zone P. The waste gases resulting from the products of combustion thus circulated from the cooling zone C to the preheating zone P and the hot products of combustion directly propagated from the firing zone F into the preheating zone P are forcibly discharged from the preheating zone P and are partially utilized to form an air curtain at the entrance end 32 of the tunnel kiln 30. The furnace embodying the present invention is further characterized in that uniformaly turbulent flows of atmosphere are induced in each of the firing zone F and the forced circulation area $P_3$ of the preheating zone P. The turbulent flows thus induced in this area and zone create turbulent flows in the other areas of the preheating zone P and in the cooling zone C and thus establish turbulent flows throughout the length of the furnace chamber 58 of the tunnel kiln 30. The charges W passed through the tunnel kiln 30 can therefore be thermally processed under conditions practically obeying a theoretical heat-treatment curve. In the firing zone F, in particular, the flame ports 106 and 106' (FIG. 5) in the side walls 38 and 38', respectively, of the kiln 30 are arranged in staggered relationship to one another in vertical and longitudinal directions of the furnace chamber 58 so that substantially non-luminous, sufficiently short flames are injected at high velocities into alternately upper and lower end portions of the furnace chamber 58 in lateral directions of the kiln 30. The swirling tendency of the turbulent flows of the combustion gases thus produced in the furnace chamber 58 cause convection of heat in the furnace chamber 58, so that heat is transferred to the charges W in the firing zone F not only by the radiation of heat from the flame ports 106 and 106' but also by the convention of heat around the charges W. Another outstanding feature of the furnace according to the present invention as hereinbefore described is that the waste-gas discharge ports 78 and 78' (FIG. 2) of the preheating zone P are located close to the entrance end 32 of the tunnel kiln 30. The waste-gas discharge ports 78 and 78' being thus located close to the entrance end 32 of the kiln 30, the atmosphere in the forced circulation area $P_3$ of the preheating zone P is urged to flow toward the entrance end 32 of the kiln 30 by the suction created in the waste-gas discharge area $P_2$ so that the charges W to be fired can be preheated at temperatures which increase progressively as the charges W are moved forwardly from the entrance end 32 of the kiln 30.

The furnace embodying the present invention is further characterized in that a relatively hot mixture of hot gases and fresh air is injected into a lower portion of the furnace chamber 58 and is partially discharged upwardly from the furnace chamber 58 and partically recirculated sidewise from an upper portion of the furnace chamber 58 in the direct cooling area $C_2$. Forced convection of heat is thus established in the furnace chamber 58 in the direct cooling area $C_2$ of the cooling zone C so that the charges W being passed through the area $C_2$ can be cooled uniformly and efficiently. In the low-temperature indirect cooling area $C_3$ of the cooling zone C, furthermore, the charges W are cooled by the air circulated through the finned cooling tubes 168 exposed to the atmosphere in the furnace chamber 58. The air thus passed through the finned cooling tubes 168 is heated without consuming the oxygen component thereof and therefore effectively supports the combustion of fuel in the firing zone F.

Figure 10:
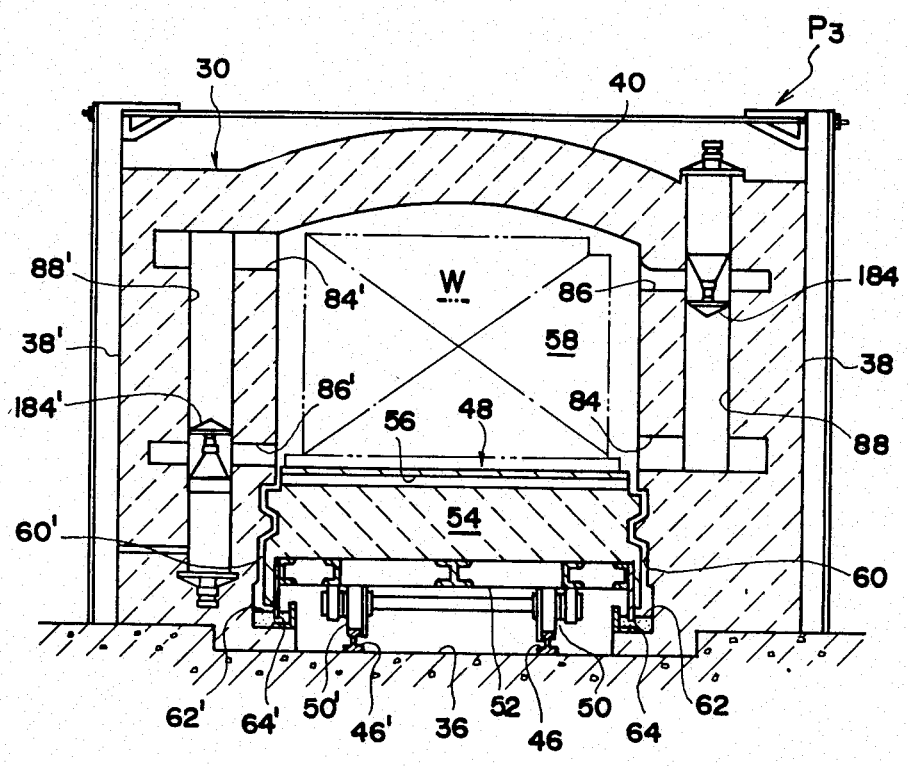
FIG. 10 is a cross sectional view similar to FIG. 3 but shows a modification of the arrangement of the forced circulation area of the preheating zone in the embodiment illustrated in FIG. 1.

While it has been described that injection nozzles are used for injecting hot gases into the furnace chamber 58 in the forced circulation area $P_3$ of the preheating zone P or cooling gases into the furnace chamber 58 in the direct cooling area $C_2$ of the cooling zone C, forced-circulation fans may be used for the same purpose. FIG. 10 of the drawings shows a cross section of a continuous combustion furnace using such fans in the forced circulation area $P_3$ of the preheating zone P.

In the forced circulation area $P_3$ illustrated in FIG. 10, the side walls 38 and 38' of the kiln 30 are formed with hot-gas injection ports 84 and 84', suction ports 86 and 86', and gas recirculation chambers 88 and 88', respectively, which are arranged similarly to their respective counterparts in the arrangement shown in FIGS. 3 and 4. An axial flow forced circulation fan 185 is provided in each of the gas recirculation chambers 88 in the side wall 38 and, likewise, an axial-flow forced-circulation fan 185' is provided in each of the gas recirculation chambers 88' in the side wall 38' of the kiln 30. Each of the forced-circulation fans 185 and 185' is positioned in such a manner as to produce an induced flow of gases from each of the suction ports 84 and 84' toward each of the gas recirculation chambers 88 and 88' and a forced flow of gases from each of the gas recirculation chambers 88 and 88' toward each of the hot-gas injection ports 86 and 86'. Thus, the hot gases in the furnace chamber 58 of the kiln 30 in the forced circulation area $P_3$ of the preheating zone P are drawn into each of the gas recirculation chambers 88 and 88' through the two suction ports 86 and 86' communicating with each gas recirculation chamber by the suction induced in each of the suction ports 86 and 86' by each of the forced-circulation fans 185 and 185'. The hot gases thus admitted into the gas recirculation chambers 88 and 88' are injected through the hot-gas injection ports 84 and 84', respectively, into the furnace chamber 58 by the blast induced by each of the fans 185 and 185'.

The use of forced-circulation fans in the forced circulation area $P_3$ of the preheating zone P as in the arrangement shown in FIG. 10 is advisable especially where the atmosphere in the furnace chamber in the particular area of the preheating zone is maintained at temperatures lower than about 700° C. Where the atmosphere in the furnace chamber in the forced circulation area of the preheating zone is to be maintained at temperatures higher than about 700° C., the use of injection nozzles as in the arrangement illustrated in FIGS. 3 and 5 is preferred. If, furthermore, the temperature of the atmosphere in the furnace chamber in the forced circulation area of the preheating zone is lower than about 300° C., the system using injection nozzles will prove advantageous over the system using forced-circulation fans since, under such conditions, fine particles of dust may be deposited on the surfaces of the runners of the fans due to the moisture contained in the gases circulated from the direct cooling area $C_2$ of the cooling zone C.

Figure 11:
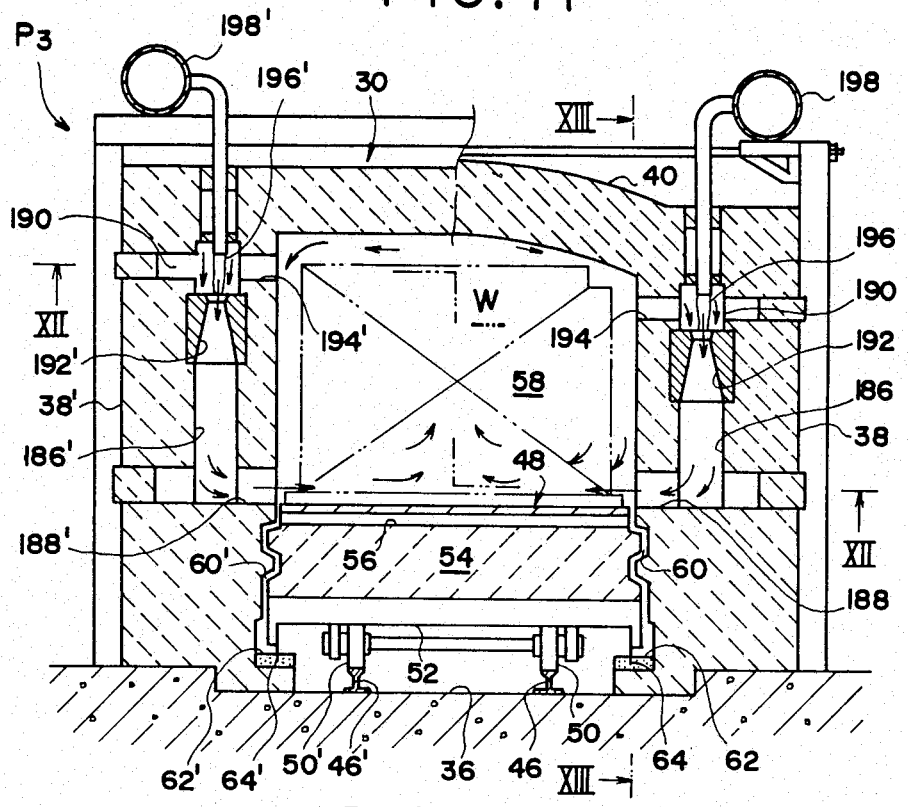
FIG. 11 is a view also similar to FIG. 3 but shows another modification of the arrangement of the forced circulation area of the preheating zone in the embodiment of FIG. 1.
Figure 12:
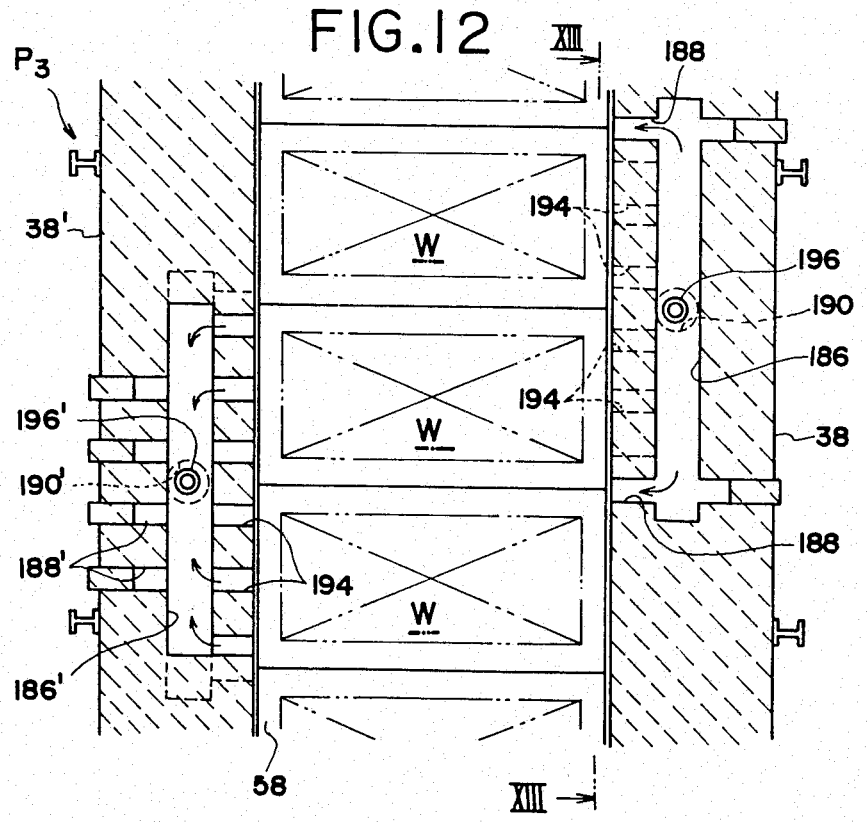
FIG. 12 is a fragmentary horizontal sectional view taken on a horizontal plane indicated by lines XII—XII in FIG. 11.
Figure 13:
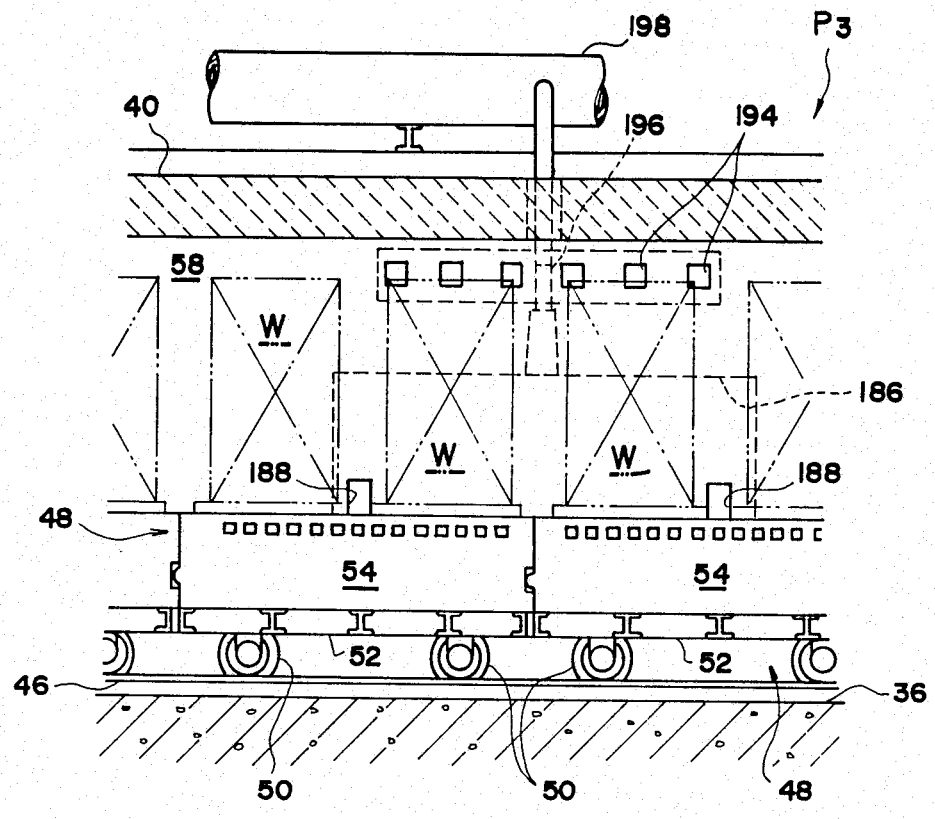
FIG. 13 is a fragmentary sectional view taken on a vertical plane indicated by lines XIII—XIII in each of FIGS. 11 and 12.

FIGS. 11, 12 and 13 of the drawings shows a modification of the forced circulation area $P_3$ of the preheating zone P in the embodiment of the continuous combustion furnace hereinbefore described with reference to FIGS. 1 to 9. In the forced circulation area $P_3$ illustrated in FIGS. 11, 12 and 13, the side walls 38 and 38' of the kiln 30 have a plurality of vertical hot-gas injection chambers 186 formed in the side wall 38 and a series of vertical cooling-gas injection chambers 186' formed in the side wall 38'. The hot-gas injection chambers 186 in the side wall 38 are arranged in staggered relationship to the hot-gas injection chambers 186' in the side wall 38' longitudinally of the kiln 30. Each of the hot-gas injection chambers 186 and 186' is elongated in a longitudinal direction of the kiln 30 with a suitable length. Each of the hot-gas injection chambers 186 in the side wall 38 communicates with the furnace chamber 58 through a number of hot-gas outlet slots 188 formed in the side wall 38 open to a lower portion of the furnace chamber 58 in lateral directions of the kiln 30. Each of the cooling-gas injection chambers 186' in the side wall 38' likewise communicates with the furnace chamber 58 through a number of hot-gas outlet slots 188' formed in the side wall 38' and open to a lower portion of the furnace chamber 58 in lateral directions of the kiln 30. The side walls 38 and 38' of the kiln 30 further have a series of hot-gas mixing chambers 190 formed in the side wall 38 and a series of hot-gas mixing chambers 190' formed in the side wall 38'. Each of hot-gas mixing chambers 190 in the side wall 38 is downwardly open to each of the hot-gas injection chambers 186 through a diffuser passageway 192 having a lower leading end portion divergent toward the hot-gas injection chamber 186. Similarly, each of the hot-gas mixing chambers 190 in the side wall 38' is downwardly open to each of the hot-gas injection chambers 186' through a diffuser passageway 192' having a lower leading end portion divergent toward the hot-gas injection chamber 186'. Each of the hot-gas mixing chambers 190 in the side wall 38 is further open to a plurality of hot-gas circulation ports 194 also formed in the side wall 38 and, likewise, each of the hot-gas mixing chambers 190' in the side wall 38' is further open to a plurality of hot-gas circulation ports 194' formed in the side wall 38'. The hot-gas circulation ports 194 thus formed in the side wall 38 are open to an upper end portion of the furnace chamber 58 in lateral directions of the kiln 30 and, likewise, the hot-gas circulation ports 194' formed in the side wall 38' are open to an upper end portion of the furnace chamber 58 in lateral directions of the kiln 30. A hot-gas injection nozzle 196 axially projects downwardly into each of the hot-gas mixing chambers 190 in the side wall 38 and, similarly, a hot-gas injection nozzle 196' axially projects downwardly into each of the hot-gas mixing chambers 190' in the side wall 38'. The individual hot-gas injection nozzles 196 thus projecting into the side wall 38 of the kiln 30 jointly lead from a common hot-gas distribution duct 198 extending longitudinally along and above the side wall 38 and, likewise, the individual hot-gas injection nozzles 196' projecting into the side wall 38' of the kiln 30 jointly lead from a common hot-gas distribution duct 198' extending longitudinally along and above the side wall 38'. Though not shown in the drawings, the two cooling-gas distribution ducts 198 and 198' are branched from a single hot-gas feed passageway leading from a suitable source of hot gases such as the hot-gas outlet port **94*b* of the heat recuperator 94 and having incorporated therein suitable forced-flow or induced-flow producing meand such as the forced-circulation fan 98 as in the arrangement illustrated in FIG. 1**.

Throughout operation of the furnace including the forced circulation area $P_3$ arranged as above described in the preheating zone P thereof, hot gases are continuously circulated through the hot-gas feed ducts 198 and 198' to the individual hot-gas injection nozzles 196 and 196'. The hot gases thus directed to each of the hot-gas injection nozzles 196 and 196' are injected into each of the diffuser passageways 192 and 192' and through each diffuser passageway into each of the hot-gas injection chambers 190 and 190' and are further injected into the furnace chamber 58 through the hot-gas outlet slots 188 leading from each of the hot-gas supply chambers 186 in the side wall 38 and the hot-gas outlet slots 188' leading from each of the hot-gas supply chambers 186' in the side wall 38' of the kiln 30. The hot gases thus injected into the furnace chamber 58 through the hot-gas outlet slots 188 and 188' are partially drawn into the hot-gas supply chambers 186 and 186' through the hot-gas circulation ports 194 and 194' in the side walls 38 and 38', respectively, of the kiln 30 by the suction established in each of the hot-gas mixing chambers 190 and 190' by the jet stream of gases spurting from each of the injection nozzles 196 and 196'. The hot gases thus forced into each of the hot-gas mixing chambers 190 and 190' through each of the hot-gas circulation ports 194 and 194' are mixed with the hot gases injected from each of the nozzles 196 and 196' into each of the hot-gas mixing chambers 190 and 190', respectively. Thus, the atmosphere in the furnace chamber 58 in the forced circulation area $P_3$ of the preheating zone P is injected into a lower portion of the furnace chamber 58 and is partially recirculated sidewise from an upper portion of the furnace chamber 58 in the forced circulation area $P_3$. Forced convection of heat is thus established in the furnace chamber 58 in the forced circulation area $P_3$ of the preheating zone P so that the charges W being passed through the area $P_3$ can be heated uniformly and efficiently.

Figure 14:
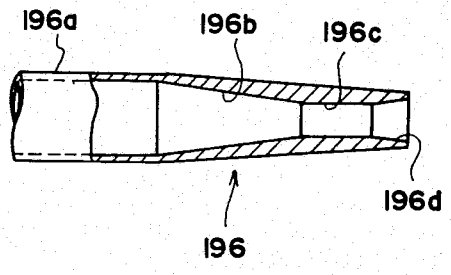
FIG. 14 is a fragmentary longitudinal sectional view of a hot-gas injection nozzle used in the arrangement illustrated in FIGS. 11 to 13.

Each of the hot-gas injection nozzles 196 and 196' used in the arrangement illustrated in FIGS. 11, 12 and 13 is of the convergent-divergent type and is constructed of a heat-resistant cast steel. Each nozzle, represented by the nozzle 196 in FIG. 14, leads from a hot-gas feed tube **196*a* and is formed with an axial passageway having three axial passageway portions which consist of a convergent inlet passageway portion 196*b*** leading from the passageway in the hot-gas feed tube 196*a*, a cylindrical intermediate passageway portion 196*c* merging forwardly out of the inlet passageway portion 196*b*, and a divergent outlet passageway portion 196*d* merging forwardly out of the intermediate passageway portion 196*c* and open at the leading end of the nozzle 196. Each of the hot-gas injection nozzles 92 and 92′ in the arrangement illustrated in FIGS. 3 and 4 and the cooling-gas injection nozzles 148 and 148′ in the arrangement illustrated in FIGS. 7 and 8 may also be constructed as above described.

Figure 15:
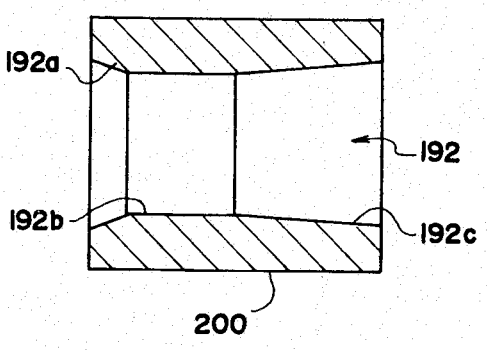
FIG. 15 is a longitudinal sectional view of a diffuser passageway used in the arrangement illustrated in FIGS. 11 to 13.
Figure 16:
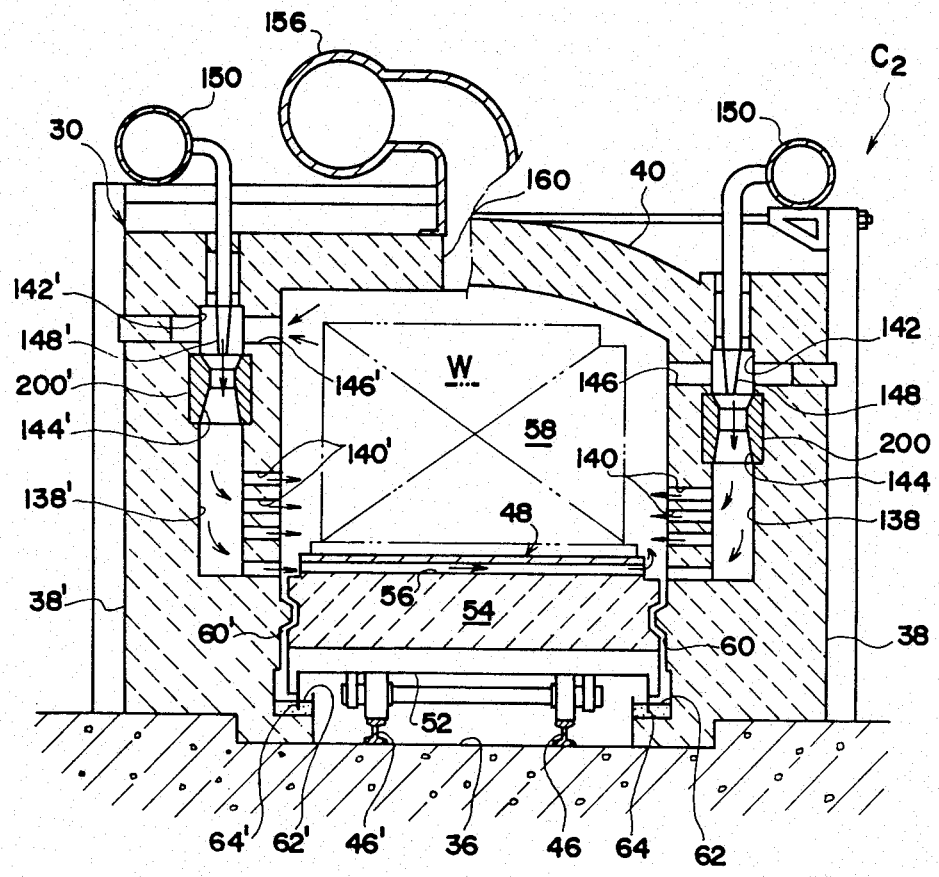
FIG. 16 is a cross sectional view similar to FIG. 7 but shows a modification of the arrangement of the direct cooling area of the cooling zone in the embodiment illustrated in FIG. 1.

On the other hand, each of the diffuser passageways 192 and 192′ in the arrangement illustrated in FIGS. 11, 12 and 13 is formed in a tubular member 200 of a suitable refractory as shown in FIG. 15 of the drawings. Each diffuser passageway, represented by an axial bore 192 in FIG. 15, formed in the tubular member 200 also has three axial bore portions which consist of a convergent inlet bore portion 192*a*, a cylindrical intermediate bore portion 192*b* merging forwardly out of the inlet bore portion 192*a*, and a divergent outlet bore portion 192*c* merging forwardly out of the intermediate bore portion 192*b*. The tubular member 200 thus shaped is arranged in conjunction with the hot-gas injection nozzle 196 shown in FIG. 14 in such a manner that the axial bore in the tubular member 200 and the axial passageway in the nozzle 196 have their respective center axes aligned with each other. The diffuser passageways 144 and 144′ provided in the direct cooling area $C_3$ of the cooling zone C illustrated in FIGS. 7 and 8 may also be formed in tubular member similar to the above described tubular member 200 as indicated at 200 and 200′, respectively, in FIG. 16 of the drawings.

Figure 17:
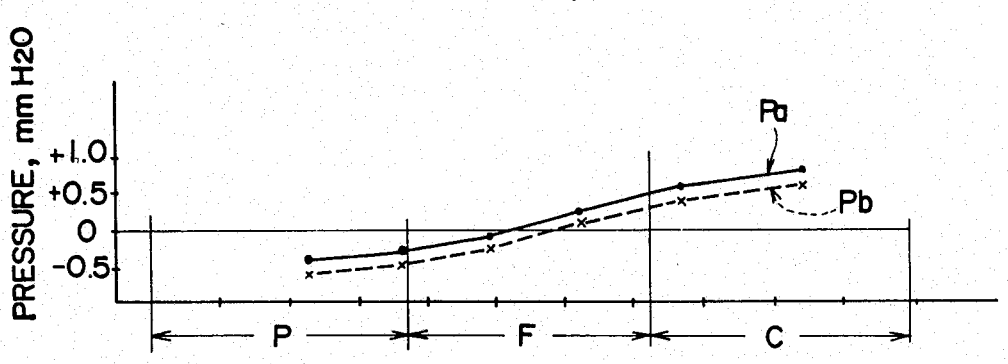
FIG. 17 is a graph showing a preferred example of the relationship between the pressure (or suction) of the atmosphere in the furnace chamber of the kiln and pressure (or suction) below the furnace chamber in a continuous combustion furnace according to the present invention.

The pressure of the atmosphere in the furnace chamber 58 of the kiln 30 varies markedly with the pressure of gases below the furnace chamber 58, particularly the pressure of air in the spaces below the charge loading blocks 54 of the carrier cars 48. In order that the pressure of the atmosphere in the furnace chamber 58 be maintained at optimum levels throughout operation of the furnace and throughout the length of the kiln 30, it is thus of importance to strictly regulate the pressure of gases below the furnace chamber 58, particularly the pressure of air in the spaces below the charge loading blocks 54 of the carrier cars 48 depending upon the pressure of the atmosphere in the furnace chamber 58. In the firing and cooling zones F and C of the kiln 30, in particular, the gases below the furnace chamber 58 are heated by the hot atmosphere allowed into the side clearances 60 and 60′ on both sides of the charge loading blocks 54 of the carrier cars 48 and thus tend to expand with a resultant rise in the gas pressure. For this reason, not only the pressure but also the temperature of the gases below the furnace chamber 58 should be regulated depending upon the pressure and temperature distributions in the furnace chamber 58 in longitudinal directions of the firing and cooling zones F and C of the kiln 30. On the other hand, the pressure of the atmosphere in the furnace chamber 58 in the preheating zone P is normally at subatmospheric levels and becomes minimum in the vicinity of the entrance end 32 (FIG. 1) of the waste-gas discharge area $P_2$ of the preheating zone P. Since, furthermore, the temperature of the gases below the furnace chamber 58 in the preheating zone P becomes lower from the exit end 34 (FIG. 1) toward the entrance end of the particular zone, it is desirable to regulate the suction below the furnace chamber 58 and heat the gases below the furnace chamber 58 in the preheating zone P of the kiln 30 so as to maintain the pressure of the atmosphere in the furnace chamber 58 at proper levels and to preheat the charge loading blocks 54 of the carrier cars 48 in the particular zone. FIG. 17 of the drawings shows a preferred example of the relationship between the pressure (or suction) Pa of the atmosphere in the furnace chamber and the pressure (or suction) Pb of the gases below the furnace chamber when the pressure Pb is controlled in accordance with the pressure Pa as above described. Experiments have revealed that the pressure Pb thus controlled is preferably lower by approximately 0.8 $mmH_2O$ and, more preferably, approximately 0.3 $mmH_2O$ than the pressure Pa.

FIGS. 18 to 23 of the drawings show a preferred embodiment of a continuous combustion furnace having a pressure regulator system which is thus operable for regulating the pressure (or suction) of the gases below the furnace chamber. The embodiment herein shown is in other respects entirely similar in construction and arrangement to the embodiment described with reference to FIGS. 1 to 9.

Figure 18:
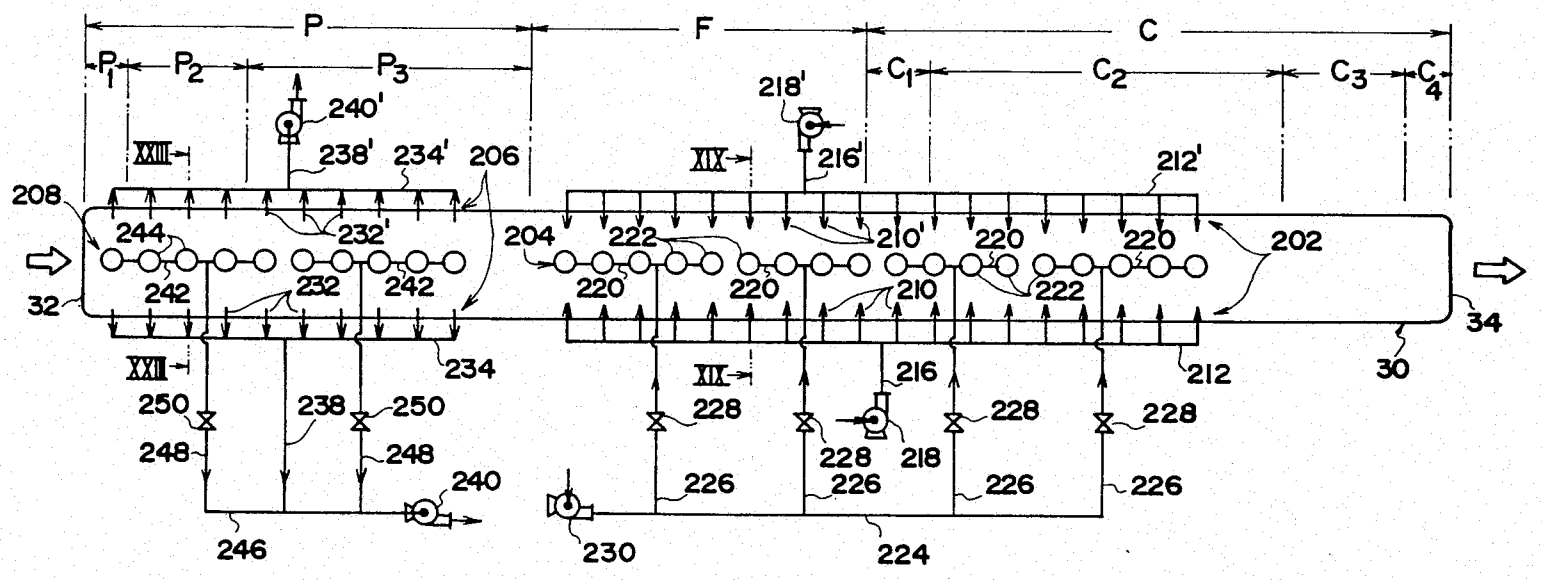
FIG. 18 is a schematic plan view showing the general arrangement of the pressure regulator system in another embodiment of the continuous combustion furnace according to the present invention.

As schematically illustrated in FIG. 18, the pressure regulator system provided in the embodiment of FIGS. 18 to 23 largely comprises four pressure regulating means which consist of first forced-circulation fresh-air feed means 202 for blowing fresh air into the side clearances 60 and 60′ on both sides of the charge loading blocks 54 of the charge carrier cars 48 in the firing and cooling zones F and C, second forced-circulation fresh-air feed means 204 for blowing fresh air into the spaces below the charge loading blocks 54 of the carrier cars 48 in the firing and cooling zones F and C, first forced-circulation air discharge means 206 for forcibly discharging air from the side clearances 60 and 60′ on both sides of the charge loading blocks 54 of the carrier cars 48 in the preheating zone P, and forced-circulation air discharge means 208 for forcibly discharging air from the spaces below the charge loading blocks 54 of the cars 48 in the preheating zone P.

Figure 19:
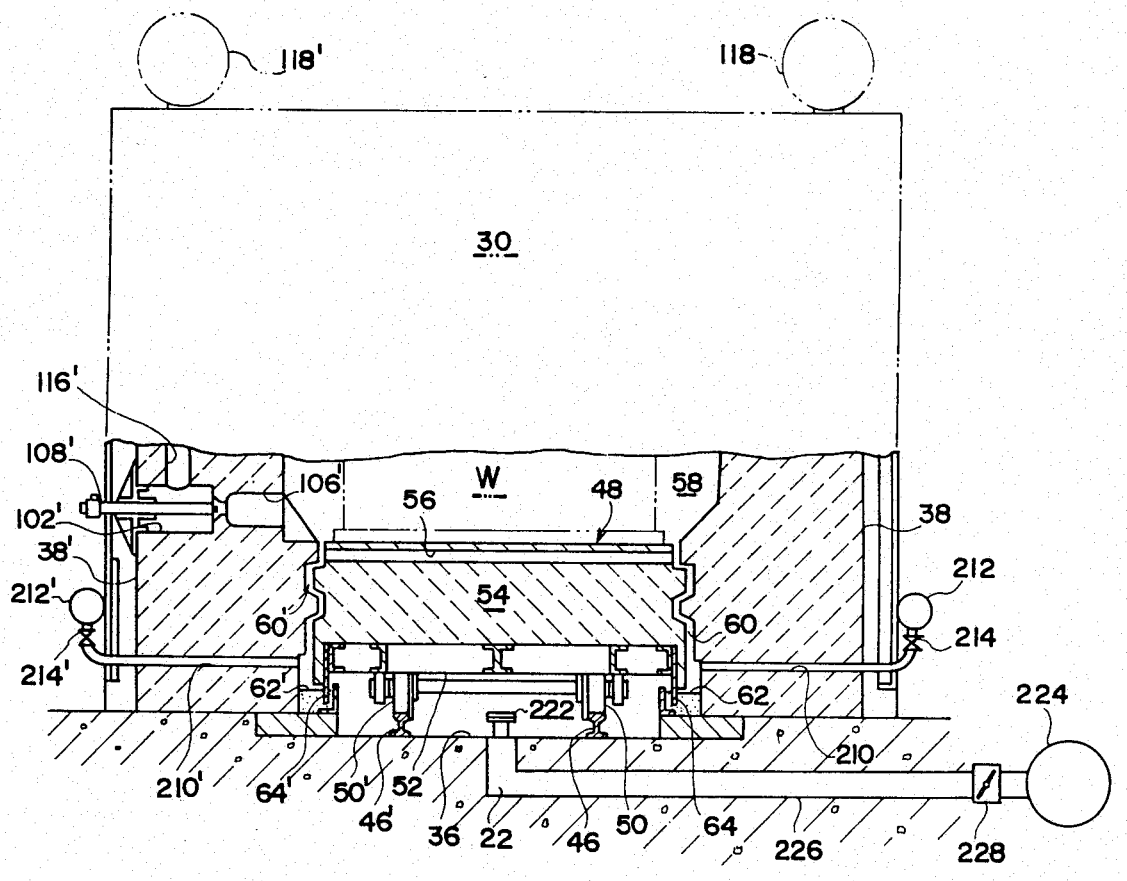
FIG. 19 is a fragmentary cross sectional view partially taken on a vertical plane indicated by lines XIX—XIX in FIG. 18.

As illustrated more specifically in FIG. 19, the first forced-circulation fresh-air feed means 202 comprises a plurality of air feed passageways 210 formed in a lower end portion of the side wall 38 of the kiln 30 and a plurality of air feed passageways 210′ formed in a lower end portion of the side wall 38′ of the kiln 30. The air feed passageways 210 in the side wall 38 extend in lateral directions of the kiln 30 and are open at their leading ends to the side clearance 60 between the inner face of the side wall 38 of the kiln 30 and the charge loading blocks 54 of the carrier cars 48 in the firing and cooling zones F and C. Likewise, the air feed passageways 210′ in the side wall 38′ extend in lateral directions of the kiln 30 and are open at their leading ends to the side clearance 60′ between the inner face of the side wall 38′ of the kiln 30 and the charge loading blocks 54 of the carrier cars 48 in the firing and cooling zones F and C. The respective open leading ends of the passageways 210 and 210′ are disposed at suitable intervals of, for example, 2 meters from one another in longitudinal directions of the side walls 38 and 38′, respectively, of the kiln 30. The air feed passageways 210 in the side wall 38 jointly lead from a common air distribution duct 212 through flow regulator dampers 214 respectively, and, likewise, the air feed passageways 210′ in the side wall 38′ jointly lead from a common air distribution duct 212′ through flow regulator dampers 214′, respectively. As schematically illustrated in FIG. 18, the air distribution ducts 212 and 212′ communicate through fresh-air supply passageways 216 and 216' with the air outlet ports of suitable forced-flow or induced-flow producing means such as power-driven forced-circulation fans 218 and 218', respectively, each having its air inlet port open to the atmosphere.

Figure 22:
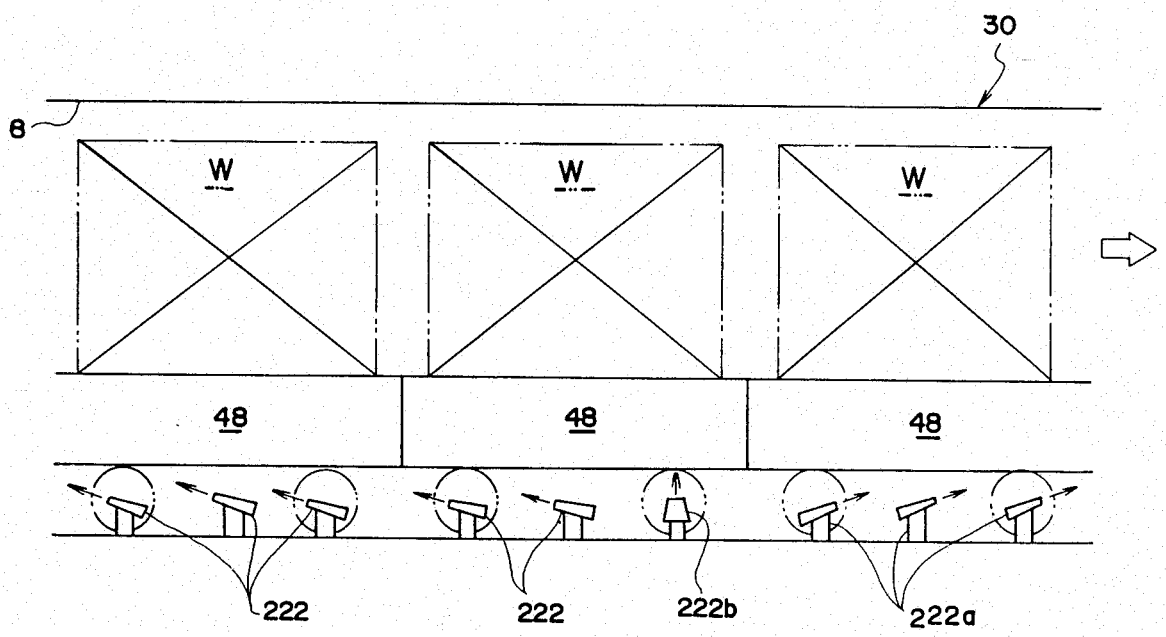
FIG. 22 is a fragmentary side elevation view showing part of the fresh-air outlet duct arrangement in the cooling zone of the furnace illustrated in FIG. 18.

On the other hand, the second forced-circulation fresh-air feed means 204 of the pressure regulator system comprises an elongated fresh-air distribution duct 220 embedded in the floor 36 and extending in a longitudinal direction of the kiln 30 in the firing and cooling zones F and C, as will be seen from FIGS. 18 and 19. As illustrated partially and to an enlarged scale in FIGS. 20 and 21, the fresh-air distribution duct 220 has formed in its upper wall portion a plurality of taps through which fresh-air outlet ducts 222 are connected to the duct 220. The outlet ducts 222 are disposed at suitable spacings from one another throughout the length of the distribution duct 220 and project upwardly into the spaces below the charge loading blocks 54 of the charge carrier cars 48 as shown in FIG. 19. Each of the fresh-air outlet ducts 222, except for a suitable number of ducts located adjacent the foremost end (closest to the exit end 34 of the kiln 30) of the distribution duct 220 as designated particularly by **222*a* in FIGS. 20 to 22, has an air outlet opening directed toward the preheating zone P as will be seen from FIGS. 21 to 23. Each of the particular fresh-air outlet ducts 222*a* located adjacent the foremost end of the distribution duct 220 has an air outlet opening directed toward the exit end 34 of the kiln 30 as will also be seen from FIGS. 20 to 23. At least one fresh-air outlet duct located adjacent these ducts 222*a* as designated by 222*b* in FIG. 22 is open upwardly. The spacings between the fresh-air outlet ducts 222 thus arranged are preferably approximately two times the spacing between every adjacent two of the sleepers (not shown) on which the rails 46 and 46'** lie.

The second forced-circulation fresh-air feed means 204 further comprises a main fresh-air supply duct 224 extending in parallel with the above described fresh-air distribution duct 220. A suitable number of branch ducts 226 extend in parallel with each other perpendicularly from the fresh-air supply duct 224 as will be seen from FIG. 18 and are connected at their respective leading ends to the distribution duct 220 through taps formed in a side wall portion of the duct 220 as will be seen from FIG. 21. Thus, the main fresh-air supply duct 224 communicates with the fresh-air distribution duct 220 through the individual branch ducts 226 and is open to the spaces below the charge loading blocks 54 of the charge carrier cars 48 (FIG. 19) through the fresh-air discharge ducts 222. The branch ducts 226 are preferably arranged at spacings each of which is eight times the spacing between every adjacent two of the sleepers (not shown) below the rails 46 and 46'. Each of the branch ducts 226 has provided therein a flow regulator damper 228 as indicated by broken lines in FIG. 21 for making it possible to manually or automatically regulate the flow rate of air through each branch duct. As illustrated schematically in FIG. 18, the main fresh-air supply duct 224 leads from the air outlet port of suitable forced-flow or induced-flow producing means such as a power-driven forced-circulation fan 230 having its air inlet port open to the atmosphere.

The respective outlet ends of the air feed passageways 210 and 210' of the first forced-circulation fresh-air feed means 202 and the fresh-air outlet ducts 222 of the second forced-circulation fresh-air feed means 204 are assumed, by way of example, as being located in the firing zone F and the high-temperature indirect cooling area $C_1$ and the indirect cooling area $C_2$ of the cooling zone C, as will be seen from FIG. 18. Thus, the air feed passageways 210 and 210' and the fresh-air outlet ducts 222 are not provided in the low-temperature indirect cooling area $C_3$ and the exit air shutoff area $C_4$ of the cooling zone C. This is because of the fact that the temperature of the atmosphere in these areas $C_3$ and $C_4$ of the cooling zone C is maintained at relatively low leves as compared with the temperatures of the atmosphere in the areas $C_1$ and $C_2$ of the zone C, so that the pressure and temperature of air below the furnace chamber 58 in the areas $C_3$ and $C_4$ need not be strictly regulated. If desired, however, the air feed passageways 210 and 210' and the fresh-air discharge ducts 222 may be provided not only in the high-temperature indirect cooling area $C_1$ and the direct cooling area $C_2$ but also in the low-temperature indirect cooling area $C_3$ and the exit air shutoff area $C_4$ of the cooling zone C.

Figure 23:
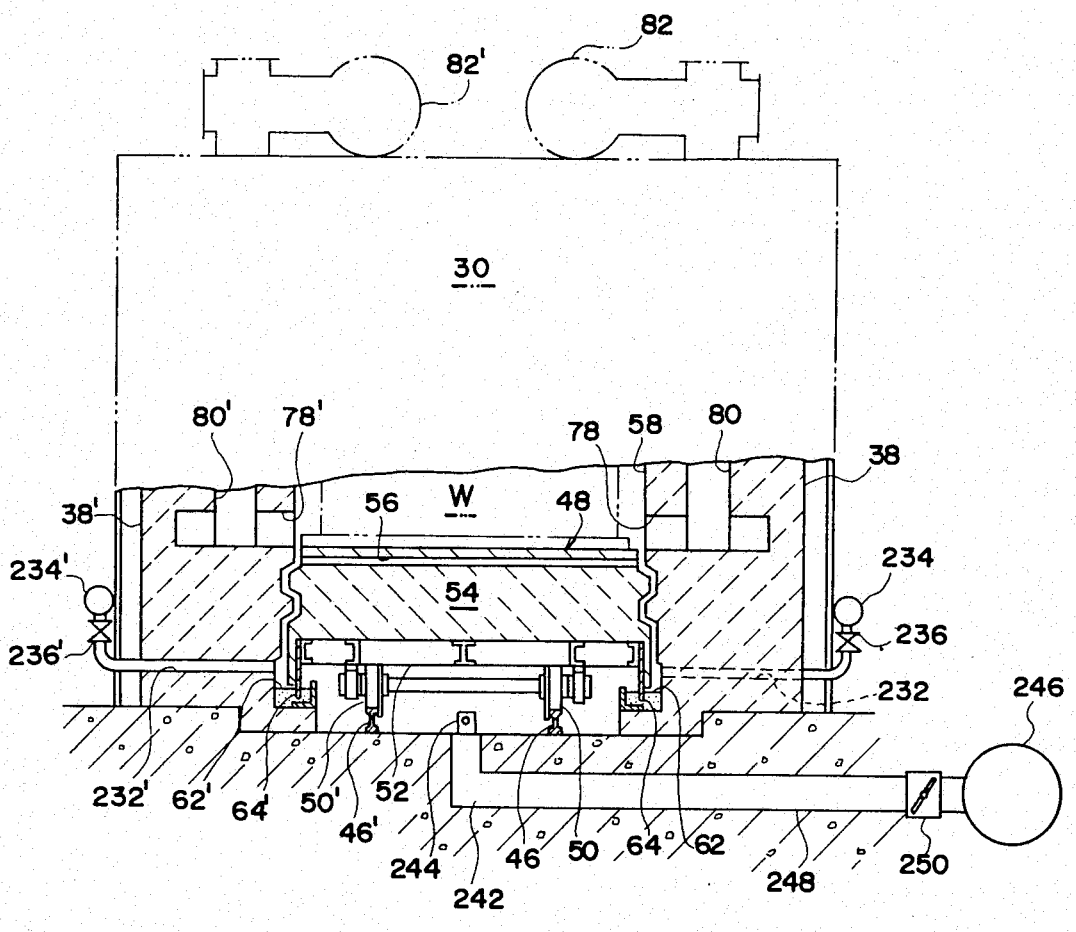
FIG. 23 is a fragmentary cross sectional view partially taken on a vertical plane indicated by lines XXIII—XXIII in FIG. 18.

On the other hand, the first forced-circulation air discharge means 206 of the pressure regulator system comprises a plurality of air discharge passageways 232 formed in a lower end portion of the side wall 38 of the kiln 30 and a plurality of air discharge passageways 232' formed in a lower portion of the side wall 38' of the kiln 30, as illustrated in FIG. 23 of the drawings. The air discharge passageways 232 in the side wall 38 extend in lateral directions of the kiln 30 and are open at their leading ends to the side clearance 60 between the inner face of the side wall 38 of the kiln 30 and the charge loading blocks 54 of the charge carrier cars 48 in the preheating zone P. Likewise, the air discharge passageways 232' in the side wall 38' of the kiln 30 extend in lateral directions of the kiln 30 and are open at their leading ends to the side clearance 60' between the inner face of the side wall 38' and the charge loading blocks 54 of the charge carrier cars 48 in the preheating zone P. The respective open leading ends of the passageways 232 and 232' are disposed at suitable intervals of, for example, 2 meters from one another in longitudinal directions of the side walls 38 and 38', respectively, of the kiln 30. The air discharge passageways 232 in the side wall 38 jointly lead from a common air collector duct 234 through flow regulator dampers 236, respectively, and likewise, the air discharge passageways 232' in the side wall 38' jointly lead from a common air collector duct 234' through flow regulator dampers 236', respectively. As schematically shown in FIG. 18, the air collector ducts 234 and 234' communicate through air outlet passageways 238 and 238' with the air inlet ports of suitable forced-flow or induced-flow producing means such as power-driven forced-circulation fans 240 and 240', respectively, each having its air outlet port open to the atmosphere.

Figure 24:
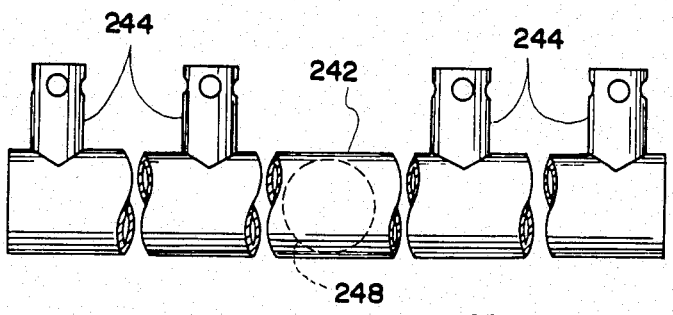
FIG. 24 is a fragmentary side elevation view showing portions of the duct arrangement forming part of the pressure regulator system in the preheating zone of the furnace illustrated in FIG. 18.
Figure 24:
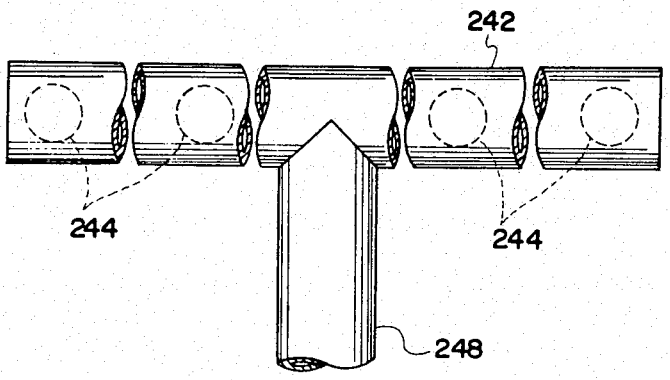
Figure 25:
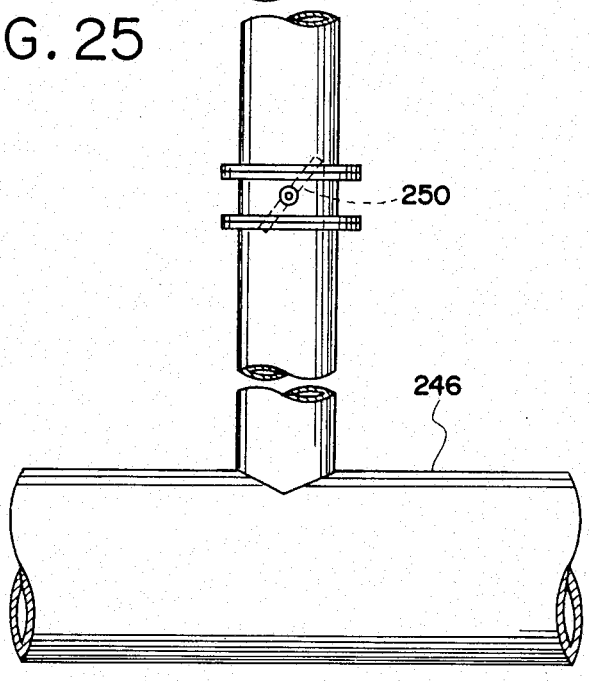
FIG. 25 is a fragmentary plan view showing portions of the duct arrangement illustrated in FIG. 24.

Furthermore, the second forced-circulation air discharge means 208 of the regulator system comprises an elongated air collector duct 242 embedded in the floor 36 and extending in a longitudinal direction of the kiln 30 in the preheating zone P, as will be seen from FIGS. 18 and 23. As illustrated partially and to an enlarged scale in FIGS. 24 and 25 of the drawings, the air collector duct 242 has formed in its upper wall portion a plurality of taps through which air inlet ducts 244 are fitted to the duct 242. The air inlet ducts 244 are disposed at suitable spacings from one another throughout the length of the air collector duct 242 and project upwardly into the spaces below the charge loading blocks 54 of the charge carrier cars 48 as shown in FIG.

23. Each of the spacings between the air inlet ducts 244 thus arranged is preferably approximately equal to two times the spacing between every adjacent two of the sleepers (not shown) underneath the rails 46 and 46'. The second forced-circulation air discharge means 208 further comprises a main air discharge duct 246 extending in parallel with the above mentioned air collector duct 242. A suitable number of branch ducts 248 extend in parallel with each other perpendicularly from the main air discharge duct 246 and are connected at their leading ends to the air collector duct 242 through taps formed in a side wall portion of the duct 242 as will be seen from FIG. 25. The main air discharge duct 246 is thus in communication with the air collector duct 242 through the individual branch ducts 248 and is open to the spaces below the charge loading blocks 54 of the charge carrier cars 48 (FIG. 23) through the air inlet ducts 244. The branch ducts 248 are preferably arranged at spacings each of which is approximately eight times the spacing between every adjacent two of the sleepers below the rails 46 and 46'. Each of the branch ducts 248 has provided therein a flow regulator damper 250 as indicated by broken lines in FIG. 25, so as to make it possible to manually or automatically regulate the flow rate or air through each of the branch ducts 248. As illustrated schematically in FIG. 18, the main air discharge duct 246 leads from the air inlet port of one of the previously described forced-circulation fans 240 and 240' such as the fan 240 as shown.

The respective inlet ends of the air discharge passageways 232 and 232' of the first forced-circulation air discharge means 206 and the air inlet ducts 244 of the second forced-circulation air discharge means 208 are assumed, by way of example, as being located in the entrance air shutoff area $P_1$, the waste-gas discharge area $P_2$ and a longitudinal portion of the forced circulation area $P_3$ of the preheating zone P. The longitudinal portion of the forced circulation area $P_3$ is contiguous to the waste-gas discharge area $P_2$ and is preferably such that the length thereof accounts for approximately two thirds of the total length of the forced circulation area $P_3$.

When, now, the pressure regulator system constructed and arranged as hereinbefore described is in operation, all the forced-circulation fans 218, 218', 230, 240 and 240' of the system are continuously driven to produce forced circulation of air in the regulator system. Fresh air is thus continuously drawn into the air supply passageways 216 and 216' of the first forced-circulation fresh-air feed means 202 through the forced-circulation fans 218 and 218', respectively, and into the main fresh-air supply duct 224 of the second forced-circulation fresh-air feed means 204 through the forced-circulation fan 230. The air thus drawn into the air supply passageways 216 and 216' is passed through the air distribution passageways 212 and 212' and past the flow regulator dampers 214 and 214' to the air feed passageways 210 and 210' and is blown into the side clearances 60 and 60' (FIG. 19) on both sides of the charge loading blocks 54 of the carrier cars 48 by way of the air feed passageways 210 and 210', respectively in the firing zone F and the high-temperature indirect cooling area $C_1$, the direct cooling area $C_2$ and the low-temperature indirect cooling area $C_3$ of the cooling zone C. On the other hand, the air drawn into the main fresh-air supply duct 224 is circulated past the flow regulator dampers 228 to the fresh-air distribution duct 220 by way of the branch ducts 226 and is blown into the spaces below the charge loading blocks 54 of the carrier cars 48 through the fresh-air outlet ducts 222 in the firing zone F and the areas $C_1$, $C_2$ and $C_3$ of the cooling zone C. The fans 218 and 218' and the flow regulator dampers 214 and 214' of the first forced-circulation fresh-air feed means 202 are conditioned so that the pressure of the blast in each of the air feed passageways 210 and 210' downstream of the flow resulator dampers 214 and 214', respectively, is maintained within a predetermined range of, for example, about 150 $mmH_2O$ to about 200 $mmH_2O$. The fan 230 and the flow regulator dampers 228 of the second forced-circulation fresh-air feed means 204 are also conditioned so that the pressure of the blast in each of the branch ducts 226 downstream of the flow regulator dampers 228 is maintained within a predetermined range of, for example, about 150 $mmH_2O$ to about 200 $mmH_2O$. Under these conditions, the pressure Pb of air below the furnace chamber 58 in a lengthwise intermediate area of the firing zone F is maintained at a subatmospheric level slightly lower than the zero level and the pessure Pa of the atmosphere in the furnace chamber 58 in the particular area is maintained within a range higher by about 0.3 $mmH_2O$ to about 0.8 $mmH_2O$ than the pressure Pb as will be seen from the curves of FIG. 17.

The forced-circulation fans 240 and 240' of the first forced-circulation air discharge means 206 being in operation, furthermore, suction is created in the air outlet passageways 238 and 238' of the first forced-circulation air discharge means 206 and accordingly in the side clearances 60 and 60' in the preheating area P. The air blown into the side clearances 60 and 60' in the firing zone F and the areas $C_1$, $C_2$ and $C_3$ of the cooling zone C by the first forced-circulation fresh-air feed means 202 and thus heated by the hot atmosphere in the furnace chamber 58 in the firing zone F and the areas $C_1$, $C_2$ and $C_3$ of the cooling zone C is forced to flow into the side clearances 60 and 60' in the preheating zone P by the suction developed in the zone P and enters the air discharge passageways 232 and 232'. The air thus admitted into the air discharge passageways 232 and 232' is circulated past the flow regulator dampers 236 and 236' to the air collector ducts 234 and 234' and by way of the ducts 234 and 234' to the air outlet passageways 238 and 238' and is discharged into the open air through the fans 240 and 240', respectively. The fan 240 being in operation, furthermore, suction is also created in the main air discharge duct 246 of the second forced-circulation air discharge means 208 and accordingly in the spaces below the charge loading blocks 54 of the carrier cars 48 in the preheating zone P. The air blown into the spaces below the charge loading blocks 54 of the carrier cars 48 in the firing zone F and the areas $C_1$, $C_2$ and $C_3$ of the cooling zone C by the second forced-circulation fresh-air feed means 204 and thus heated by the transfer of heat from the furnace chamber 58 through the charge carrier cars 48 in the firing zone F and the areas $C_1$, $C_2$ and $C_3$ of the cooling zone C is forced to flow into the spaces below the charge loading blocks 54 of the carrier cars 48 in the preheating zone P by the suction created in the zone P and enters the air collector duct 242 through the air inlet ducts 244. The air thus admitted into the air collector duct 242 is circulated through the branch ducts 248 and past the flow regulator dampers 250 to the main air discharge duct 246 and is discharged into the open air through the fan 240. The fans 240 and 240' and the flow regulator dampers 236 and 236' of the first forced-circulation air discharge means 206 are conditioned so that the suction established in the air discharge passageways 232 and 232' downstream of the flow regulator dampers 236 and 236' is maintained within a predetermined range of, for example, about $-150$ mm$H_2O$ to about $-200$ mm$H_2O$. Furthermore, the flow regulator dampers 250 of the second forced-circulation air discharge means 208 are conditioned so that the suction established in the branch ducts 248 downstream of the dampers 250 is maintained within a predetermined range of, for example, about $-150$ mm$H_2O$ to about $-200$ mm$H_2O$. Under these conditions, the subatmospheric pressure Pb of air below the furnace chamber 58 in the preheating zone P is maintained at a level approximating $-0.5$ mm$H_2O$ and the pressure Pa of the atmosphere in the furnace chamber 58 in the zone P is maintained at a subatmospheric level higher about 0.3 mm$H_2O$ to about 0.8 mm$H_2O$ than the subatmospheric level $-0.5$ mm$H_2O$ as will be seen from the curves of FIG. 17.

As will have been understood from the foregoing description, the pressure regulator system of the embodiment hereinbefore described with reference to FIGS. 18 to 25 is characterized in that the pressure (or suction) Pb of air in the spaces below the furnace chamber 58 is regulated in such a manner as to vary with the pressure (or suction) Pa of the atmosphere in the furnace chamber 58 and to be lower by a substantially predetermined value than the pressure (or suction) Pa. The ratio between the pressure Pa of the atmosphere in the furnace chamber 58 and the pressure Pb of air below the furnace chamber 58 is therefore maintained substantially constant throughout the preheating and firing zones P and F and the areas $C_1$, $C_2$ and $C_3$ of the cooling zone C. The pressure Pb being constantly lower than the pressure Pa, leakage of hot atmosphere is not invited from the furnace chamber 58 into the spaces below the furnace chamber 58 in the firing and cooling zones F and C. This will contribute to reduction of the fuel consumption rate in the firing zone F and to protection of the various refractory and steel members below the charge loading blocks 54 of the carrier cars 48 from the attack of heat. In the preheating zone P, furthermore, there can be no leakage of cool air from the spaces below the furnace chamber 58 into the furnace chamber 58. One of the advantages resulting therefrom is that the difference between the temperatures of the atmosphere at the top and bottom of the furnace chamber 58 in the preheating zone P is reduced to about 100° C. to about 150° C. where the temperature of the atmosphere at the top of the furnace chamber 58 is about 600° C. Other advantages achieved by elimination of the leakage of cool air into the furnace chamber 58 in the preheating zone P include the improved preheating efficiency, the reduction of the fuel consumption rate in the firing zone F and the reduction in the amount of gases discharged from the waste-gas discharge area $P_2$ of the zone P. The reduction of the amount of gases discharged from the preheating zone P contributes to reduction of the load to be imparted to the forced-circulation fan 72 (FIG. 1) and accordingly to the saving of the electric power to be consumed by the fan 72.

The fresh air blown into the spaces below the charge loading blocks 54 of the carrier cars 48 in the firing and cooling zones F and C serves not only for regulating the pressure of air in the particular spaces but also for cooling the air in the spaces. The air thus heated in the spaces below the charge loading blocks 54 of the carrier cars 48 in the firing and cooling zones F and C propagates into the preheating zone P and further serves to moderately preheat the carrier cars 48 travelling through the preheating zone P and from the preheating zone P to the firing zone F. The flows of air propagating in the spaces below the furnace chamber 58 from the firing zone F into the preheating zone P produce drafts of air toward the entrance end 32 of the kiln 30, so that the air in the spaces below the furnace chamber 58 in the preheating zone P is facilitated to enter the air discharge passageways 232 and 232' (FIGS. 18 and 23) and the air inlet ducts 244 (FIGS. 18 and 24) throughout the lengths of the air distribution ducts 212 and 212' and the air collector duct 242.

While it has been described that the first forced-circulation fresh-air feed means 202 and the first forced-circulation air discharge means 206 are provided separately from each other across a foremost region of the forced circulation area $P_3$ of the preheating zone P, the fresh-air feed means and the air discharge means of the pressure regulator system of a furnace according to the present invention may be arranged in such a manner as to overlap each other in the particular region of the forced circulation area $P_3$. In this instance, the air feed passageways 210 and 210' (FIG. 19) are formed in the side walls 38 and 38', respectively, of the kiln 30 not only in the firing and cooling zones F and C but in the foremost region of the forced circulation area $P_3$ of the preheating zone P and, likewise, the air discharge passageways 212 and 212' (FIG. 23) are formed in the side walls 38 and 38', respectively, of the kiln 30 not only in the areas $P_1$ and $P_2$ of the preheating zone P but throughout the length of the forced circulation area $P_3$ of the preheating zone P. Similarly, the second forced-circulation fresh-air feed means 204 and the second forced-circulation air discharge means 208 which have been described as being provided separately of each other across the foremost region of the forced-circulation area $P_3$ of the preheating zone P may be arranged in such a manner as to overlap each other in the particular region of the area $P_3$. In this instance, the air distribution duct 220 (FIGS. 20 and 21) is extended into the forced circulation area $P_3$ of the preheating zone P so as to have some of the fresh-air outlet ducts 222 located in the foremost region of the forced circulation area $P_3$ and, likewise, the air collector duct 242 (FIGS. 24 and 25) is extended toward the firing zone F so as to have some of the air inlet ducts 244 located in the foremost region of the forced circulation area $P_3$ of the preheating zone P.

The pressure regulator system of the furnace hereinbefore described with reference to FIGS. 18 to 25 is advantageous especially when used for a continuous combustion furnace for low-to-high temperature operations. Such a pressure regulator system may however be readily modified to be suitable for a continuous combustion furnace for low-to-medium or medium-to-high temperature operations. To modify the pressure regulator system to be suitable for a furnace for low-to-medium temperature operations, the second forced-circulation fresh-air feed means 204 and the second forced-circulation air discharge means 208 may be dispensed with. In this instance, air is circulated only through the side clearances 60 and 60' on both sides of the charge loading blocks 54 of the carrier cars 48. On the other hand, the first forced-circulation fresh-air feed means 202 and the first forced-circulation air discharge means 206 may be dispensed with when the pressure regulator system of the described nature is to be modified to be suitable for a furnace for medium-to-high temperature operations. In this instance, air is circulated only through the spaces below the charge loading blocks 54 of the carrier cars 48 so as to compensate for the high degree of pressure or suction in the furnace chamber 58.

What is claimed is:

1. A method of heat processing charges loaded on charge loading blocks of a train of charge carrier cars travelling through a tunnel kiln elongated between an open entrance end and an open exit end and having a pair of side walls spaced apart substantially in parallel laterally of the kiln and longitudinally extending between the entrance and exit ends of the kiln and an upper wall bridging the side walls throughout the length of the kiln for forming a tunnel longitudinally extending between the entrance and exit ends of the kiln, comprising (1) passing said charges through an entrance air shutoff area in which an air curtain is formed in the tunnel in the kiln adjacent said entrance end of the kiln, (2) passing the charges through a waste-gas discharge area subsequent to the entrance air shutoff area and filled with hot waste gases being discharged from the tunnel in the kiln through the waste-gas discharge area, (3) passing the charges through a forced-circulation preheating area subsequent to the waste-gas discharge area and filled with hot gases injected into the forced circulation preheating area and forming tubulent flows therein, (4) passing the charges through a firing zone subsequent to the forced-circulation preheating area and filled with hot gases produced by high-velocity flames injected through said side walls of the kiln into the tunnel in the kiln, (5) passing the charges through a high-temperature indirect cooling area subsequent to the firing zone and having the side and upper walls of the kiln cooled with fresh air being circulated internally of the walls, (6) passing the charges through a direct cooling area subsequent to the high-temperature indirect cooling area and filled with a mixture of fresh air and gases being recirculated into and out of the direct cooling area, (7) passing the charges through a low-temperature cooling area subsequent to the direct cooling area and being cooled by transfer of heat to finned cooling tubes through which fresh air is being circulated, and (8) passing the charges through an exit air shutoff area in which an air curtain is formed in the tunnel in the kiln adjacent the exit end of the kiln.

2. A method as set forth in claim 1, in which said high-velocity flames are injected into alternately upper and lower portions of the tunnel in the kiln in the firing zone from each of said side walls of the kiln in lateral directions of the kiln for producing in the tunnel turbulent flows of hot gases which tend to swirl in the tunnel in lateral and vertical directions of the kiln.

3. A method as set forth in claim 1 or 2, in which the high-velocity flames are injected into the tunnel in the kiln from each of the side walls of the kiln in directions staggered with respect to the directions in which the high-velocity flames are injected into the tunnel in the kiln from the other side wall of the kiln.

4. A method as set forth in claim 1 or 2, in which hot gases are injected into alternately upper and lower portions of the tunnel in the kiln in the forced-circulation preheating area from each of the side walls of the kiln for producing in the tunnel turbulent flows of hot gases which tend to swirl in the tunnel in lateral and vertical directions of the kiln.

5. A method as set forth in claim 4, in which hot gases are injected into the tunnel in the kiln in the forced-circulation preheating area from each of the side walls of the kiln in directions staggered with respect to the directions in which hat gases are injected into the tunnel in the kiln from the other side wall of the kiln.

6. A method as set forth in claim 4, in which hot gases are further injected downwardly into the tunnel in the kiln in the forced-circulation preheating area through the upper wall of the kiln.

7. A method as set forth in claim 1 or 2, in which said mixture of air and gases is injected into a lower portion of the tunnel in the kiln in lateral direction of the kiln in the direct cooling area of the cooling zone for establishing forced convection of heat in the tunnel in the kiln in the direct cooling area of the cooling zone.

8. A method as set forth in claim 7, which said mixture of air and gases is injected into the tunnel in the kiln in the direct cooling area of the cooling zone from each of the side walls of the kiln in directions staggered with respect to the directions in which the mixture of air and gases is injected into the tunnel in the kiln from the other side wall of the kiln.

9. A method as set forth in claim 1, further comprising blowing fresh air into a bottom portion of the tunnel in the kiln inwardly in lateral directions of the kiln in the firing zone and at least a longitudinal portion of the cooling zone, and discharging air from a bottom portion of the tunnel in the kiln outwardly in lateral directions of the kiln in at least a portion of the preheating zone.

10. A method as set forth in claim 1, further comprising blowing gresh air upwardly into a bottom portion of the tunnel in the kiln in the firing zone and at least a longitudinal portion of the cooling zone, and discharging air downwardly from a bottom portion of the tunnel in the kiln in at least a longitudinal portion of the preheating zone.

11. A method as set forth in claim 1, further comprising blowing fresh air into a bottom portion of the tunnel in the kiln inwardly in lateral directions of the kiln in the firing zone and at least a longitudinal portion of the cooling zone, blowing fresh air upwardly into a bottom portion of the tunnel in the kiln in the firing zone and at least said longitudinal portion of the cooling zone, discharging air from a borrom portion of the tunnel in the kiln outwardly in lateral directions of the kiln in at least a longitudinal portion of the preheating zone, and discharging air downwardly from a bottom portion of the tunnel in the kiln in at least said longitudinal portion of the preheating zone.

12. A method as set forth in claim 1 or 2, in which said high-velocity flames are produced by burning atomized fuel oil and are injected into the tunnel in the kiln at velocities higher than about 20 meters/sec with use of fuel burners with burning capacities higher than about $2\times10^7$ k·cal/m$^3$·hr.

13. A method as set forth in claim 1 or 2, in which said high-velocity flames are produced by burning fuel gas and are injected into the tunnel in the kiln at velocities higher than about 80 meters/sec with use of burners having burning capacities higher than about $5\times10^7$ k·cal/m$^3$·hr.

14. A method as set forth in claim 9, 10 or 11, in which the pressure of the atmosphere in an upper portion of the tunnel in the kiln is maintained higher about 0.8 mm$H_2O$ than the pressure of air in a lower portion of the tunnel substantially throughout the length of the kiln.

15. A method as set forth in claim 9, 10, or 11, in which the pressure of the atmosphere in an upper portion of the tunnel in the kiln is maintained higher about 0.3 mm$H_2O$ than the pressure of air in a lower portion of the tunnel substantially throughout the length of the kiln.

* * * * *